US012302958B2

(12) United States Patent
Ichigaya

(10) Patent No.: US 12,302,958 B2
(45) Date of Patent: May 20, 2025

(54) BODY OF AIR-CONDITIONING GARMENT AND AIR- CONDITIONING GARMENT

(71) Applicant: SFT LABORATORY CO., LTD., Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 226 days.

(21) Appl. No.: 17/291,805

(22) PCT Filed: Nov. 8, 2019

(86) PCT No.: PCT/JP2019/043951
§ 371 (c)(1),
(2) Date: May 6, 2021

(87) PCT Pub. No.: WO2020/100757
PCT Pub. Date: May 22, 2020

(65) Prior Publication Data

US 2021/0386129 A1 Dec. 16, 2021

(30) Foreign Application Priority Data

Nov. 12, 2018 (JP) ..... 2018-211885

(51) Int. Cl.
*A41D 13/002* (2006.01)
*A41D 27/28* (2006.01)

(52) U.S. Cl.
CPC ..... *A41D 13/0025* (2013.01); *A41D 27/28* (2013.01)

(58) Field of Classification Search
CPC .. A41D 13/0025; A41D 13/002; A41D 13/02; A41D 13/0007; A41D 13/1209; A41D 27/28
See application file for complete search history.

(56) References Cited

U.S. PATENT DOCUMENTS 1,360,390 A * 11/1920 Gilfillan ..... A41D 27/28 2/DIG. 1
1,360,391 A * 11/1920 Gilfillan ..... A41D 27/28 2/DIG. 1

(Continued)

FOREIGN PATENT DOCUMENTS

EP 0412450 A1 * 2/1991
EP 1555489 A2 7/2005

(Continued)

OTHER PUBLICATIONS

International Preliminary Report on Patentability (IPRP) (and English language translation thereof) dated May 11, 2021 Issued in International Application No. PCT/JP2019/043951.

(Continued)

*Primary Examiner* — Patrick J. Lynch
(74) *Attorney, Agent, or Firm* — Holtz, Holtz & Volek PC

(57) ABSTRACT

A body of a garment that is formed of a fabric, which is not air-permeable or has a level of air-permeability that allows inflation by introduction of air by a fan, in a shape that covers at least the torso of a wearer. The body is provided with shoulder-suspended members that link first connection parts located on the front bodice of the body of the garment with second connection parts located on the back bodice of the body of the garment. When suspended from the shoulders of the wearer, the shoulder-suspended members form a circulation pathway for air introduced from the fan to circulate between the shoulder-suspended members and the fabric located near the shoulder-suspended members. As a result, there is provided a body of an air-conditioning garment and an air-conditioning garment with less discomfort while securing an air circulation pathway in the region near the shoulders.

7 Claims, 10 Drawing Sheets

(56) References Cited

U.S. PATENT DOCUMENTS

| | | | | |
|---|---|---|---|---|
| 2,460,269 | A | 2/1949 | Appeldoorn | |
| 5,970,519 | A | 10/1999 | Weber | |
| 6,186,381 | B1 * | 2/2001 | Kernkamp | A47D 13/025 224/159 |
| 8,656,516 | B1 * | 2/2014 | Reinhardt Rawlings | A41D 11/00 2/69 |
| 11,140,931 | B1 * | 10/2021 | Stewart | A41D 13/0007 |
| 2002/0062510 | A1 * | 5/2002 | Mullen | A41D 13/0007 2/69 |
| 2004/0163156 | A1 * | 8/2004 | Schweer | A41D 13/0007 2/69 |
| 2005/0029418 | A1 * | 2/2005 | Lee | A41B 9/06 248/214 |
| 2006/0041990 | A1 * | 3/2006 | Alesina | A41D 27/28 2/93 |
| 2007/0271939 | A1 | 11/2007 | Ichigaya | |
| 2009/0070915 | A1 * | 3/2009 | Hill | A41B 1/00 2/311 |
| 2011/0214212 | A1 * | 9/2011 | Marx | A41D 13/0007 2/2.5 |
| 2014/0263517 | A1 * | 9/2014 | Redli | A63C 11/025 224/576 |
| 2015/0231419 | A1 | 8/2015 | Allan et al. | |
| 2015/0342272 | A1 * | 12/2015 | Bonime | A41D 13/02 2/230 |
| 2018/0132550 | A1 * | 5/2018 | Czajka | A62B 18/003 |

FOREIGN PATENT DOCUMENTS

| | | | | |
|---|---|---|---|---|
| FR | 2515048 | A1 | 4/1983 | |
| GB | 2155761 | A * | 10/1985 | A41D 13/0007 |
| JP | 2006307354 | A | 11/2006 | |
| JP | 3206518 | U | 9/2016 | |
| JP | 2017101354 | A * | 6/2017 | A41D 13/002 |
| JP | 2018141256 | A | 9/2018 | |
| NO | 2005063065 | A1 | 7/2005 | |

OTHER PUBLICATIONS

Extended European Search Report (EESR) dated Dec. 16, 2021, issued in counterpart European Application No. 19885986.0.

International Search Report (ISR) (and English language translation thereof) dated Feb. 4, 2020 issued in International Application No. PCT/JP2019/043951.

Written Opinion dated Feb. 4, 2020 issued in International Application No. PCT/JP2019/043951.

* cited by examiner

BODY OF AIR-CONDITIONING GARMENT AND AIR- CONDITIONING GARMENT

TECHNICAL FIELD

The present invention relates to a body of an air-conditioning garment, and an air-conditioning garment.

BACKGROUND ART

In recent years, an air-conditioning garment that cools a body has been put into practical use and is rapidly becoming widespread.

Conventional air-conditioning garments include:

a garment body constituted by low-breathable garment cloth;

two fans attached to a lower part of the garment body on a rear side;

a power source that supplies power to the two fans; and a power cable that electrically connects the power source with the two fans.

When the fans are activated, the fans takes a large amount of air into the garment body. Pressure of the air taken in automatically creates an air flow passage between the garment body and a wearer's body. The taken-in air circulates through the created air flow passage along a surface of the wearer's body or underwear. The air is discharged outside through, for example, openings in a collar and sleeves.

The taken-in air evaporates sweat on the wearer's body while flowing through the air flow passage between the garment body and the wearer's body or underwear. The heat of vaporization generated by evaporating sweat cools the body.

To enhance cooling function of such air-conditioning garments, it is preferable that an air flow passage is formed over the entire space between the garment body and the wearer's body or underwear. However, when the air-conditioning garment is worn, a weight of the air-conditioning garment is concentrated on portions corresponding to the wearer's shoulders. Shoulder portions of the garment cloth of the garment body of the air-conditioning garment is in close contact with the wearer's body or underwear. In areas around the wearer's shoulders, the air flow passage is unlikely to be formed solely by the pressure of the air taken in by the fan. Since the air flow passage is not formed in the portion, an amount of air discharged from the openings of the collar and sleeves is not sufficient. It is difficult to improve cooling function. The areas around shoulders include areas above, in front of, and behind a wearer's shoulders (portion from a connection between a wearer's arms and trunk to a base of a neck) in the space between the wearer's body or underwear and the garment cloth of the garment body of the air-conditioning garment.

In view of this, a known air-conditioning garment is provided with a spacer protruding downward at portions of a garment body of the air-conditioning garment, the portions corresponding to shoulders of a wearer (see, for example, Patent Literature 1).

CITATION LIST

Patent Literature

Patent Literature 1: WO 2005/063065

SUMMARY OF INVENTION

Technical Problem

However, such a spacer focuses weight of the air-conditioning garment on one point on the wearer's shoulder. It makes the air-conditioning garment uncomfortable. Although increasing an area of the spacer solves the problem, in that case, the spacer itself blocks an air flow passage around the shoulder with a large area. The air flow passage may not be sufficiently formed.

An object of the present invention is to provide an air-conditioning garment and a body of an air-conditioning garment that secure air flow passages around shoulders while preventing deterioration of comfort.

Solution to Problem

To achieve the above object, a first aspect of the invention is a body of an air-conditioning garment, comprising:

a garment cloth which is not breathable or has sufficient breathability to be inflated by introduction of air by a ventilator and which forms the body in a shape that covers at least a trunk of a wearer; and a shoulder-suspended member that connects a first connection in a front part of the body with a second connection in a back part of the body, wherein the shoulder-suspended member forms a flow passage through which the air introduced by the ventilator flows between the shoulder-suspended member and a portion of the garment cloth around the shoulder-suspended member in a state where the shoulder-suspended member is suspended from a shoulder of the wearer.

A second aspect of the invention is a body of an air-conditioning garment, comprising:

a garment cloth which is not breathable or has sufficient breathability to be inflated by introduction of air by a ventilator and which forms the body in a shape that covers at least a trunk of a wearer; and a shoulder-suspended member that connects a first connection in a front part of the body with a second connection in a back part of the body, wherein the shoulder-suspended member is shorter than a portion of the garment cloth facing the shoulder-suspended member in a state where the wearer wears the body of the air-conditioning garment.

A third aspect of the invention is the body of the air-conditioning garment according to the first or second aspect, wherein the shoulder-suspended member comprises a shoulder strap which has a shape of a band or a cord and which is suspended from the shoulder of the wearer.

A fourth aspect of the invention is the body of the air-conditioning garment according to the third aspect, wherein the shoulder strap includes one or more first connectors around at least one end of the shoulder strap, and the one or more first connectors can be attached to and detached from one or more second connectors provided in the first connection and/or the second connection.

A fifth aspect of the invention is the body of the air-conditioning garment according to the fourth aspect, wherein a number of the first connectors is plural, and/or a number of the second connectors is plural.

A sixth aspect of the invention is the body of the air-conditioning garment according to any one of the third to fifth aspects, wherein the shoulder strap comprises a length adjuster that changes a length of the shoulder strap.

A seventh aspect of the invention is the body of the air-conditioning garment according to any one of the third to sixth aspects, wherein the shoulder-suspended member includes a ring member attached to the second connection, the shoulder strap passes through the ring member, a portion around one end of the shoulder strap is connected to the first connection in a right area of the front part, and a portion around another end of the shoulder strap is connected to the first connection in a left area of the front part.

An eighth aspect of the invention is the body of the air-conditioning garment according to the seventh aspect, wherein the ring member can be attached at vertically different positions.

A ninth aspect of the invention is the body of the air-conditioning garment according to the third aspect, wherein the first connection is on an outer side of the garment cloth, and the front part of the body comprises an opening through which the shoulder strap passes from an inner side of the garment cloth to the outer side.

A tenth aspect of the invention is the body of the air-conditioning garment according to the third aspect, wherein the shoulder strap comprises:

a first shoulder strap connected to the first connection; and a second shoulder strap connected to the second connection, and the first shoulder strap and the second shoulder strap are detachably connected.

An eleventh aspect of the invention is the body of the air-conditioning garment according to the tenth aspect, wherein the first shoulder strap comprises one or more first connectors, the second shoulder strap comprises one or more second connectors which can be attached to and detached from the first connectors, and a number of the first connectors is plural, and/or a number of the second connectors is plural.

A twelfth aspect of the invention is the body of the air-conditioning garment according to any one of the third to eleventh aspects, further comprising:

a shoulder-suspended member holder which comprises an opening through which the shoulder strap passes and which is at a position on an inner side of the body, the position being different from positions of the first connection and the second connection.

A thirteenth aspect of the invention is the body of the air-conditioning garment according to the first or second aspect, wherein the shoulder-suspended member is constituted by a mesh member that covers an upper portion of the trunk of the wearer.

A fourteenth aspect of the invention is the body of the air-conditioning garment according to any one of the first to thirteenth aspects, further comprising:

a spacer which keeps a distance between the trunk of the wearer and the garment cloth and which is around at least one of the first connection and the second connection.

A fifteenth aspect of the invention is the body of the air-conditioning garment according to any one of the first to fourteenth aspects, wherein at least one of the first connection and the second connection is on a sewing line of the garment cloth, and the shoulder-suspended member is sewn on the garment cloth at at least one of the first connection and the second connection.

A sixteenth aspect of the invention is an air-conditioning garment, comprising:

the body of the air-conditioning garment according to any one of the first to fifteenth aspects;

the ventilator that introduces air inside the body of the air-conditioning garment; and a power source that supplies power to the ventilator.

Advantageous Effects of Invention

The present invention provides an air-conditioning garment and a body of an air-conditioning garment that secure air flow passages around shoulders while preventing deterioration of comfort.

DESCRIPTION OF EMBODIMENTS

Hereinafter, an air-conditioning garment according to embodiments of the present invention will be described with reference to FIGS. 1 to 10. However, a scope of the claims of the present invention is not limited to examples shown in figures.

In the following description, the front, back, top, bottom, right, and left are those of a wearer in a state where the wearer wears the air-conditioning garment.

First Embodiment

A first embodiment of the present invention will be described with reference to FIGS. 1 to 4.

Configuration of Embodiment

Figure 1:
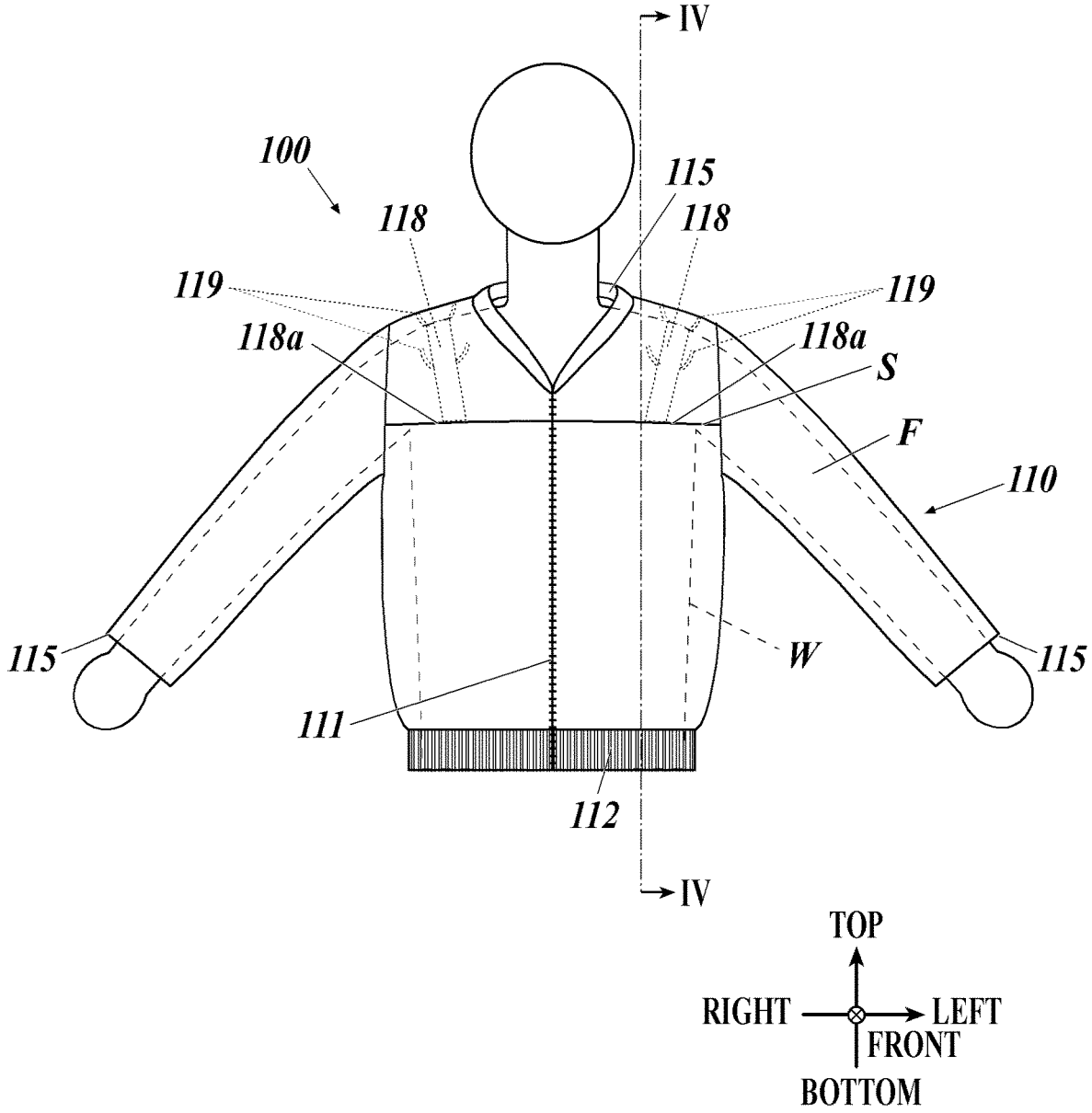
FIG. 1 is a front view of an upper body of a wearer wearing an air-conditioning garment according to a first embodiment. A garment cloth of the garment body is inflated by operating a fan. A power source, a connection cable, etc are omitted.
Figure 2:
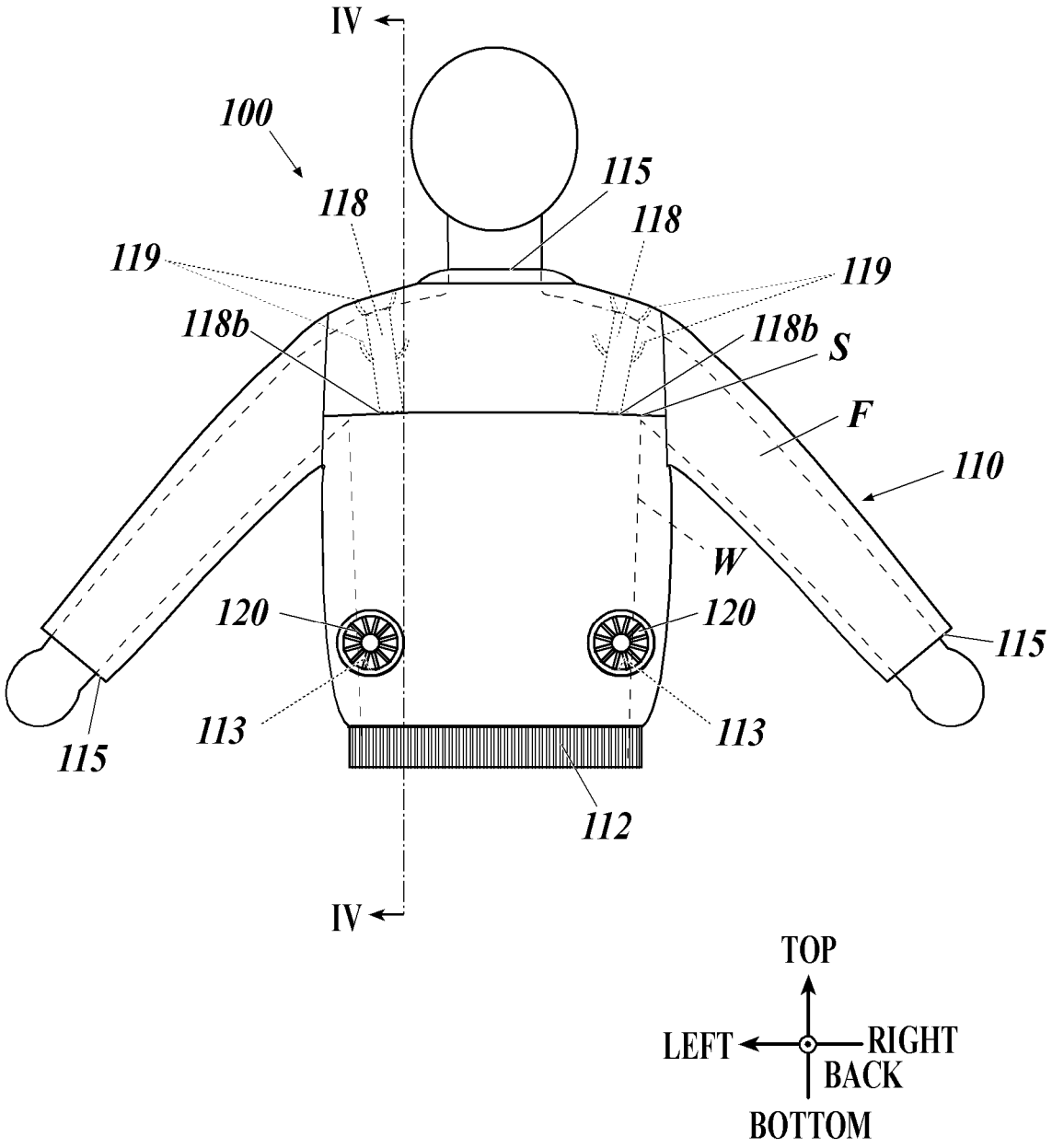
FIG. 2 is a rear view of the upper body of the wearer wearing the air-conditioning garment according to the first embodiment. The garment cloth of the garment body is inflated by operating the fan. The power source, the connection cable, etc. are omitted.
Figure 3:
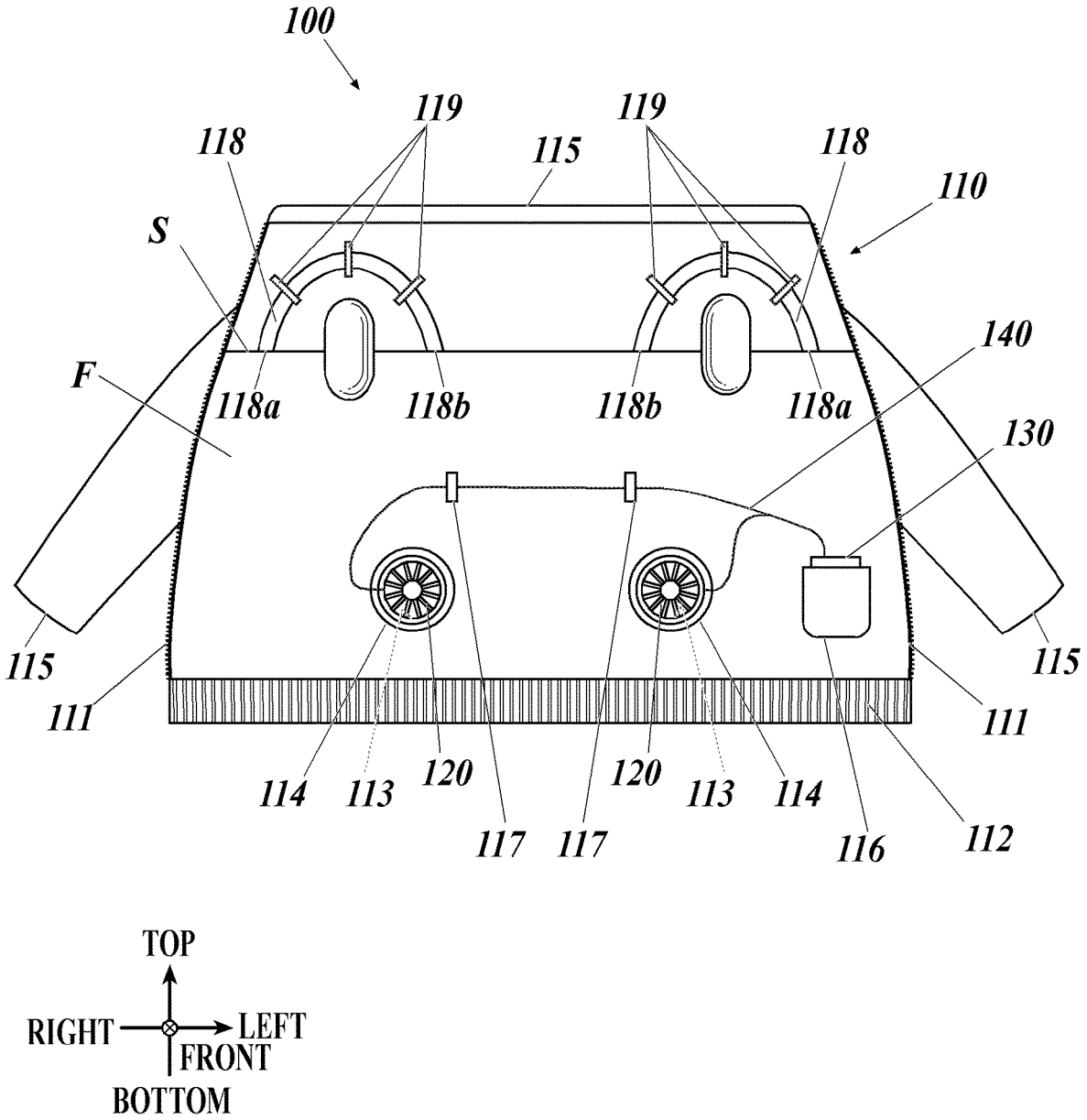
FIG. 3 is a front view of the air-condoning garment according to the first embodiment in a state where a fastener of a front part is opened.

As shown in FIGS. 1 to 3, an air-conditioning garment 100 according to the first embodiment includes a garment body 110, a fan 120 that introduces air into the garment body 110, a power source 130 that supplies power to the fan 120, and a connection cable 140 that connects the power source 130 with the fan 120. The air-conditioning garment 100 circulates air taken into the garment body 110 by the fan 120 along a surface of a body or underwear of a wearer W. It evaporates sweat on the body. Heat of vaporization generated by evaporating sweat cools the body.

Garment Body

As shown in FIGS. 1 to 3, the garment body 110 is constituted by garment cloth F, and is formed in a shape that covers a trunk and arms of the wearer W. The garment cloth F is not breathable or has sufficient breathability to be inflated by the fan 120 that introduces air. In FIGS. 1 to 3, the garment body 110 is formed in a shape of a blouson. However, the shape of the garment body 110 is not limited to this. For example, the garment body 110 may be formed in a shape of a vest that covers only a trunk of a wearer W.

An inner surface of the garment cloth F is a surface of the garment cloth F which faces a wearer W when the garment body 110 is worn. An outer surface of the garment cloth F is the surface on the opposite side, and is a surface facing the outside when the garment body 110 is worn. When the garment body 110 is worn, the inner surface of the garment cloth F as well as portions on a side of the wearer is on an inner side of the garment body 110. When the garment body 110 is worn, the outer surface of the garment cloth F as well as portions outside the garment cloth F is on an outer side of the garment body 110.

A front part of the garment cloth F covers a front part of the trunk of the wearer W. A back part of the garment, cloth F covers a back part of the trunk of the wearer W.

As shown in FIGS. 1 to 3, the garment body 110 includes a fastener 111, an air seal 112, a fan mount hole 113, a hole reinforcement member 114, an air outlet 115, a power source holder 116, a cable holder 117, a shoulder-suspended member 118, and a shoulder-suspended member holder 119. Air taken in by the fan 120 through the fan mount hole 113 is discharged from the air outlet 115.

Fastener

The fastener 111 is used to open and close a front part of the garment body 110 when the air-conditioning garment 100 is put on. As shown in FIGS. 1 and 3, the fastener 111 is provided at each edges of a division portion of the front part of the garment body 110 such that the edges of the division portion are able to be connected and separated. For example, a common zipper is used as the fastener 111.

Air Seal

As shown in FIGS. 1 to 4, the air seal 112 is at a lower part of the garment body 110, and prevents air in a space between the garment body 110 and the wearer W's body from leaking outside through a hem of the garment body 110. The air seal 112 is constituted by, for example, an elastic member such as a rubber cord. The elastic member is wound around the wearer W's body near a bottom of the garment body 110. When the air-conditioning garment 100 is worn, the hem of the garment body 110 is narrowed by the air seal 112 to come into close contact with the wearer W's body. It prevents air from leaking out through the bottom of the garment body 110.

In cases where a very small amount of air flows out through the hem, such as a case where the garment body 110 is formed in a shape in which the hem is tapered, and a case where the hem of the garment body 110 is put in trousers, the air seal 112 may not be provided.

Fan Mount Hole

As shown in FIGS. 2 to 3, the fan mount holes 113 are circular holes formed in the garment cloth F constituting the garment body 110 at positions corresponding to right and left portions of a waist of the wearer W. The fan mount hole 113 connects the space between the garment body 110 and the wearer N's body with the outside of the garment body 110 while the air-conditioning garment 100 is worn.

The fan 120 is mounted so as to pass through the fan mount hole 113. Air is taken into the garment body 110 from the outside through the fan mount hole 113.

Positions where the fan mount hole 113 are formed are not limited to the above positions. The fan mount hole 113 may be formed on a lateral side, the front side, or the like of the garment body 110.

The number of fan mount holes 113 is not limited to two, and may be less or more. The number of the fans 120 to be mounted corresponds to the number of the fan mount holes 113.

Hole Reinforcement Member

Figure 4:
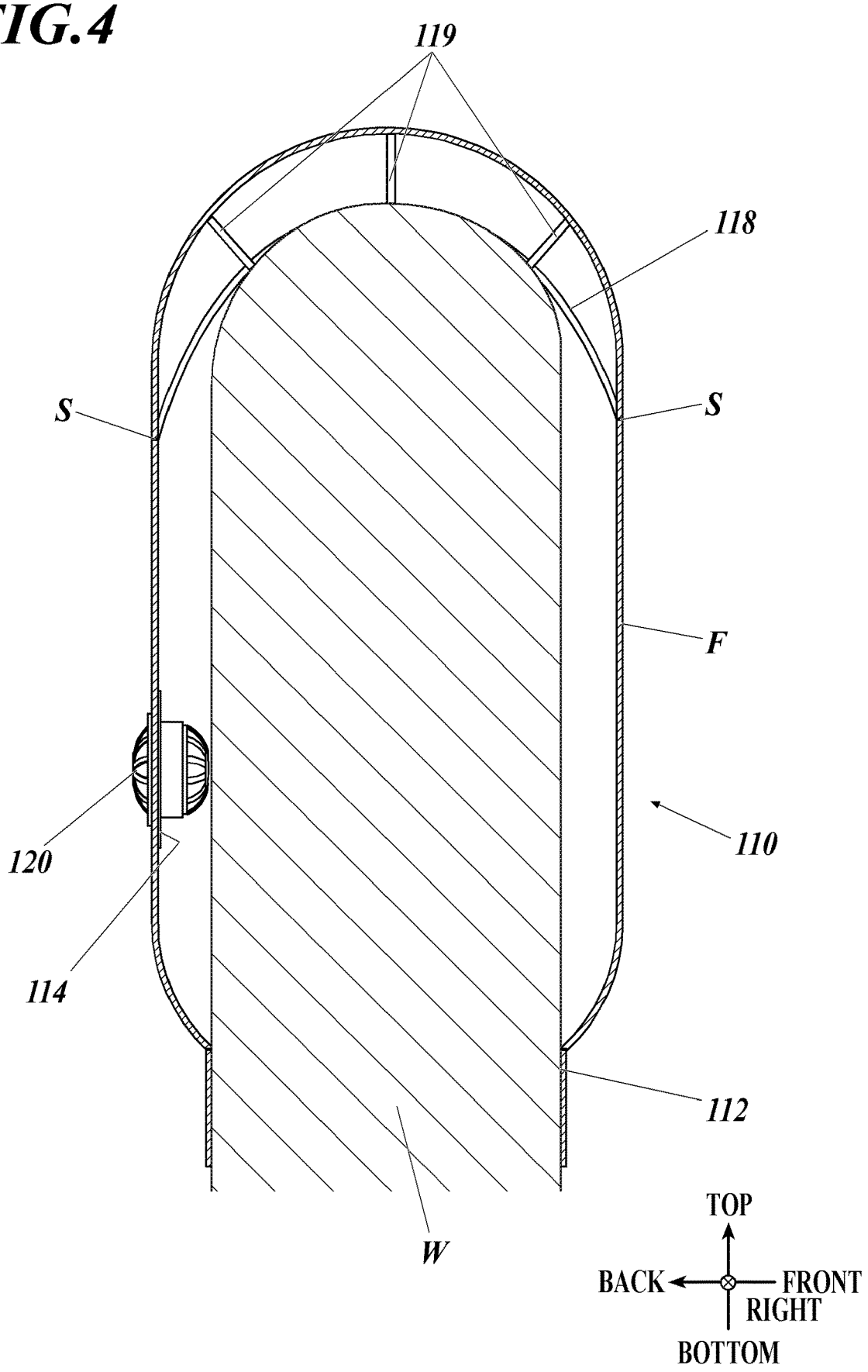
FIG. 4 is a cross-sectional view taken along the line IV-IV in FIGS. 1 and 2.

As shown in FIGS. 3 to 4, the hole reinforcement member 114 is a flat annular member made of, for example, plastic or the like. The hole reinforcement member 114 has a hole at the center, the hole having a size substantially the same as that of the fan mount hole 113. The hole reinforcement member 114 is mounted on the inner surface of the garment body 110 so that the holes overlap the fan mount holes 113. It reinforces the garment body 110 in the area around the fan mount hole 113. It makes it easier to mount the fan 120 in the fan mount hole 113 while it makes it difficult for the attached fan 120 to come off.

The hole reinforcement member 114 can be attached to the garment cloth F constituting the garment body 110 in any method, such as sewing or adhesion. A lining that covers the hole reinforcement member 114 may be provided on the inner surface of the garment body 110.

The hole reinforcement member 114 may not be provided, though it makes it difficult to mount the fan 120 and makes it easy for the fan 120 to come off.

Air Outlet

The air outlet is an opening that discharges air introduced from the fan mount hole 113 by the fan 120 after the air flows along the body or underwear of the wearer W.

As shown in FIGS. 1 to 3, the air outlet is constituted by:

an opening between a neck of the wearer W and an edge of the collar of the garment body 110; and openings between arms of the wearer W and edges of sleeves of the garment body 110.

As long as air introduced from the fan mount hole 113 by the fan 120 can be discharged after flowing along the body or underwear of the wearer W, the position of the air outlet is not limited to the collar and the sleeves.

Power Source Holder

As shown in FIG. 3, the power source holder 116 is, for example, a pocket formed on the inner surface of the garment body 110. The power source 130 is put in the power source holder 116. FIG. 3 shows a case where the power source holder 116 is provided on the left side at a lower position of the front part of the garment body 110. This is not the only case, and the power source holder 116 may be positioned anywhere on the garment body 110. For example, the power source holder may be formed on the outer side of the garment body 110. In that case, the connection cable 140 may connect the fan 120 with the power source 130 via an opening formed in the garment cloth F.

The power source holder 116 may not be a pocket. As long as the power source 130 can be attached to the garment body 110, the power source holder 116 may have any configuration. The garment body 110 may not include the power source holder 116. In that case, for example, the power source 130 is attached to a belt or the like of trousers of the wearer W with a clip or the like. The power source 130 is not attached to the garment body 110.

Cable Holder

As shown in FIG. 3, the cable holder 117 holds the connection cable 140 on the inner side of the garment body 110. For example, the cable holder 117 is formed in a shape of a ring having an opening through which the connection cable 140 passes. The cable holder 117 holds the connection cable 140 by passing the connection cable 140 through the opening.

As long as the cable holder 117 can hold the connection cable 140 at a predetermined position on the inner side of the garment body 110, the cable holder 117 may have any shape and may be made of any material. For example, like a common belt loop, the cable holder 117 is formed by sewing two upper and lower ends of a cloth that is long in a vertical direction. The position of the cable holder 117 is not limited to the position shown in FIG. 3.

Sewing Lint

The sewing line S is a port ion where the garment cloth F is sewn when the garment body is formed. The sewing line S can be formed at any position in common sewing methods for the garment body. The positions shown in FIGS. 1 to 4 are merely examples.

Shoulder-Suspended Member

As shown in FIGS. 1 to 4, shoulder-suspended members 118 are provided at two positions of the garment body 110 on the right and left, the two positions corresponding to shoulders of the wearer W. When the air-conditioning garment 100 is worn, the shoulder-suspended member 118 are suspended from the shoulders or the wearer N to hang the air-conditioning garment 100 on the shoulder.

As shown in FIGS. 1-4, the shoulder-suspended member 118 is a band having a predetermined width. One end of the shoulder-suspended member 118 is connected so a portion (first connection 118*a*) of the front part of the garment body 110, the portion being in front of the shoulder of the wearer N while the air-conditioning garment 100 is worn. The other end is connected to a portion (second connection 118*b*) of the back part of the garment body 110, the portion being behind the shoulder of the wearer N while the air-conditioning garment 100 is worn. As long as the shoulder-suspended member 118 can be suspended from the shoulder of the wearer W to hang the air-conditioning garment 100 on the shoulder while the air-conditioning garment 100 is worn, the band constituting the shoulder-suspended member 118 can be of any size. A preferred length of the band is 100 mm to 400 mm. A preferred width of the band is about 5 mm to 20 mm.

A material of the shoulder strap 118 can be any as long as it is strong enough to withstand weight while the air conditioning garment 100 is worn and flexible enough to follow a shape of the shoulder of the wearer W. For example, the same sheet as the garment cloth F of the garment body 110 can be used for the band.

In a case where a mesh member is used as the band, the breathability of the shoulder-suspended member 118 is improved. The shoulder-suspended member 118 is not likely to obstruct flow of air.

The right and left shoulder-suspended members 118 may be joined together on the rear side of the wearer. In that case, the right shoulder-suspended member 118 and the left shoulder-suspended member 118 in FIG. 2 are connected without having a divided portion. An upper portion of the back part of the wearer W is covered with one member.

It prevents the shoulder-suspended member from moving from a right position even if a shoulder-suspended member holder 119 described below is not provided. In that case, the shoulder-suspended member 118 is preferably constituted by a mesh member. Since the shoulder-suspended member 118 is constituted by the mesh member, even if an area of the shoulder-suspended member 118 is increased, it makes less influence on air flow in the garment body 110.

Connection means between the shoulder-suspended member 118 and the garment cloth F constituting the garment body 110 at the first connection 118*a* and the second connection 118*b* may be any, as long as the connection means is so strong that it does not come off due to weight of the air-conditioning garment 100 being worn. The connection means is preferably sewing.

In some cases, a sewing line S generated by sewing the garment cloth F to form the garment body 110 appears on the front part and/or back part of the garment body 110. In those cases, it is preferable that the first connection 118*a* and the second connection 118*b* overlap with the sewing line S. When the garment cloth F is sewn to form the garment body 110, the shoulder-suspended member 118 is sewn at the same time. Thus, the garment body 110 can have the shoulder-suspended member 118 without increasing the number of sewing lines. It prevents deterioration of appearance of the air-conditioning garment 100.

The shoulder-suspended member 118 is preferably a band having a predetermined width. It further disperses pressure on the shoulder of the wearer W to reduce a load on the wearer W. The shoulder-suspended member 118 is not limited to this, and may be, for example, a cord.

In that case, the weight of the air-conditioning garment 100 is concentrated on a narrow area. The pressure applied to the shoulder of the wearer W is increased as compared with the case of the band. However, the length in the front-back direction is the same as that of the band. Therefore, the load applied to the wearer W is smaller than that in the case where the pressure is concentrated on one point on the shoulder of the wearer W. Since the shoulder-suspended member 118 has a smaller area, the shoulder-suspended member 118 is less likely to obstruct flow of air.

A length of the shoulder-suspended member 118 (in the embodiment, the shortest distance between the first connection 118*a* and the second connection 118*b* along the shoulder-suspended member 118) is shorter than a length of a portion of the garment cloth F constituting the garment body 110, the portion facing the shoulder-suspended member 118 while the wearer W wears the air-conditioning garment 100 (in the embodiment, the shortest distance between the first connection 118*a* and the second connection 118*b* along the garment cloth F passing over the shoulder of the wearer W).

Shoulder-Suspended Member Holder

As shown in FIGS. 1 to 4, the shoulder-suspended member holder 119 limits a range of movement of the shoulder-suspended member 118 on the inner side of the garment body 110, and holds the shoulder-suspended member 118 at a position where it passes over the shoulder of the wearer W.

The shoulder-suspended member holder 119 needs to allow the shoulder-suspended member 118 to move within a predetermined range without completely fixing the shoulder-suspended member 118 to the garment cloth F of the garment body 110. In addition, the shoulder-suspended member holder 119 needs to keep a space between the shoulder-suspended member 118 and the garment cloth F of the garment body 110 to form an air flow passage in the space. For example, the shoulder-suspended member holder 119 is formed in a shape of a ring having an opening through which the shoulder-suspended member 118 passes. The shoulder-suspended member holder 119 holds the shoulder-suspended member 118 by passing the shoulder-suspended member 118 through the opening. Such a ring-shaped shoulder-suspended member holder 119 is formed by sewing both ends of an elongated cloth such that the length of the sewn elongated cloth is longer than the length of a portion of the garment cloth F facing the elongated cloth.

The shoulder-suspended member holder 119 may not be a ring shape as long as it can hold the shoulder-suspended member 118 as described above. For example, the shoulder-suspended member holder 119 may be a cylinder which is somewhat wide.

As shown in FIGS. 1 to 4, a predetermined number of shoulder-suspended member holders 119 are formed on the inner side of the garment body 110 along a line of the shortest distance between the first connection 118*a* and the second connection 118*b* over the shoulder of the wearer W. FIGS. 1 to 4 show a case where three ring-shaped shoulder-suspended member holders 119 are provided for one shoulder-suspended member 118. However, the shape and the number of the shoulder-suspended member holders 119 are not limited to this.

The shoulder-suspended member holder 119 prevents the shoulder-suspended member 118 from being significantly displaced from a predetermined position. This eliminates the need to adjust a position of the shoulder-suspended member 118 every time the air-conditioning garment 100 is put on. It makes the air-conditioning garment 100 easy to be put on. The shoulder-suspended member 118 does not move from a right position while being worn. The shoulder-suspended member holder 119 may not be provided. In that case, only the first connection 118*a* and the second connection 118*b* at both ends of the shoulder-suspended member 118 are held on the garment cloth of the garment body 110. It makes the air-conditioning garment. 100 less easy to be put on. The shoulder-suspended member 118 is more likely to move from a right position.

Fan

As shown in FIGS. 2 to 4, the fan 120 is attached to the garment body 110 through the fan mount hole 113. The fan 120 introduces air into the space between the garment body 110 and the wearer W's body through the fan mount hole 113.

The power source 130 supplies necessary power to the fan 120 through the connection cable 140.

The fan 120 may have any configuration as long as the fan 120 can be attached to the garment body 110 through the fan mount hole 113 to introduce air into the garment body 110.

Power Source

The power source 130 supplies power to the fan 120. For example, a lithium-ion battery with a safety protection circuit is built in the power source 130. The power source 130 includes a connection terminal (not shown) for connecting with the fan 120 through the connection cable 140.

As long as the power source 130 can supply power to the fan 120, the power source 130 may have any specific configuration.

As shown in FIG. 3, in the embodiment, the power source 130 is put in a pocket as the power source holder 116. However, as described above, means for holding the power source 130 is not limited to this.

Connection Cable

The connection cable 140 connects the power source 130 with the fan 120. The power source 130 supplies the fan 120 with power required for operating the fan 120 through the connection cable 140.

The connection cable 140 may have any specific configuration as long as the power source 130 can supply the fan 120 with power required for operating the fan 120.

As shown in FIG. 3, the cable holder 117 holds the connection cable 140 on the inner side of the garment body 110.

The fan 120 and the power source 130 may be directly connected without the connection cable 140. Alternatively, the fan 120 and the power source 130 may be integrated.

Advantageous Effect of Embodiment

While the air-conditioning garment 100 according to the embodiment is worn, the shoulder-suspended member 118 lifts the air-conditioning garment 100 in a direction away from the wearer W around the shoulder of the wearer W. When the fan 120 introduces air into the garment body 110, a sufficient air flow passage is secured around the shoulder. Air is easily sent from around the shoulder to the air outlets 115 formed on the garment body 110, especially to the air outlet 115 formed around the neck of the wearer W. It brings larger cooling effect.

At the time when the air-conditioning garment 100 is put on, a space might not be formed around the shoulder of the wearer W between the wearer W's body and the garment cloth F of the garment body 110. However, the above effect can be achieved as long as an air flow passage can be secured around the shoulder by pressure of air introduced into the garment body 110 by the fan 120.

The following is more specific explanation.

Since an air-conditioning garment is equipped with a fan and a power source, it is natural that air-conditioning garments are heavier than ordinary clothes. When an air-conditioning garment is worn, weight of the air-conditioning garment is applied to a garment cloth around the wearer's shoulders.

In a case where the air-conditioning garment does not have a means for keeping air flow passages around the wearer's shoulders, the garment cloth around the wearer's shoulders is in close contact with the wearer's body or underwear. Air flow passages are hardly formed around the wearer's shoulders. The air flow passage is divided into a front side portion and a back side portion above the air-conditioning garment. It reduces an amount of air discharged from the air outlets around the wearer's neck (collar) and in sleeves, especially the air outlet in the collar. It prevents improvement of cooling efficiency.

As shown in FIGS. 1 to 4, according to the air-conditioning garment 100 of the embodiment, the garment main body 110 is provided with shoulder-suspended members 118 suspended from the shoulders of the wearer W. The length of the shoulder-suspended member 118 (the shortest distance between the first connection 118*a* and the second connection 118*b* along the shoulder-suspended member 118) is shorter than the length of a portion of the garment cloth F constituting the garment body 110, the portion facing the shoulder-suspended member 118 while the wearer W wears the air-conditioning garment 100 (the shortest distance between the first connection 118*a* and the second connection 118*b* along the garment cloth F passing over the shoulder of the wearer W). As a result, as shown in FIGS. 1 to 4, the shoulder-suspended member 118 hangs the garment body 110. The weight of the air-condoning garment 100 is applied to the shoulder-suspended member 118. There is room around a portion of the garment cloth F that constitutes the garment body 110 around the shoulder.

In a case where the garment cloth F is hard enough to keep the shape, space is always created around the shoulder of the wearer W. Even in a case where the garment cloth F is a relatively soft and supple fabric, the garment cloth F is inflated when the fan 120 is operated. Thereby, space is created around the shoulder of the wearer W. In both cases, when the weight of the air-conditioning garment 100 is applied to the shoulders of the wearer W, the garment cloth F constituting the garment body 110 does not come into close contact with the shoulders of the wearer W. Sufficient air flow passages are formed around the shoulders of the wearer W. It increases the amount of air discharged from the air outlets formed around the wearer's neck (collar) and in sleeves. Cooling efficiency of the air-conditioning garment is improved.

To secure an air flow passage around a shoulder, the air-conditioning garment in Patent Literature 1 is provided with convex spacers at portions of a garment cloth that constitutes a garment body, the portions facing shoulders of a wearer. In that case, the spacer further blocks air flow passages around the shoulders, which are originally narrow. It obstructs flow of air.

To reduce such adverse effect, it is necessary to reduce an area in which the spacer is in contact with the wearer's shoulder by making the spacer thinner. In that case, weight of the air-conditioning garment is concentrated on one point where the spacer and the wearer's shoulder contact. Higher pressure is applied to the wearer's shoulder. It makes the garment uncomfortable to wear.

Unless a narrow area at a bottom of the spacer is put on the wearer's shoulder from above, effect of the spacer is not achieved. While the air-conditioning garment is worn, if the wearer's exercise or the like changes positional relation between the garment body and the wearer's body, it causes the spacer to lose its function even when the change in positional relation is small.

On the other hand, increasing the contact area between the spacer and the wearer's shoulder by increasing the size of the spacer reduces the pressure applied to the wearer's shoulder. Even if the positional relation between the garment body and the wearer's body somewhat changes, the function of the spacer is not easily lost.

However, the larger the spacer, the wider the range in which the spacer blocks space around the shoulder. The air flow passage is narrowed.

Thus, it has been difficult for conventional spacers to ensure a sufficient air flow passage around a shoulder while maintaining comfort of an air-conditioning garment.

However, according to the air-conditioning garment 100 of the embodiment, as shown in FIGS. 1, 2 and 4, the shoulder-suspended member 118 above the shoulder of the wearer W is in close contact with the shoulder of the wearer W. An air flow passage is formed be: the shoulder-suspended member 118 and the garment cloth F around the shoulder-suspended member 118, especially above the shoulder-suspended member 118. The shoulder-suspended member 118 does not block space around the shoulder. Air flow passages around the shoulders are efficiently formed.

The shoulder-suspended member 118 connects the front part and the back part of the garment body. Since the shoulder-suspended member 118 extends from the front side to the rear side over the shoulder of the wearer W, the weight of the air-conditioning garment is not concentrated on one point on the shoulder of the wearer W. The shoulder-suspended member 118 hardly deteriorate the comfort.

Since the shoulder-suspended member 118 extends from the front side to the rear side over the shoulder of the wearer W, the advantageous effect is not lost even if the positional relation between the garment body 110 and the wearer W's body somewhat changes.

In the case where the shoulder-suspended member 118 is a band, an area where the shoulder-suspended member 118 is in contact with the shoulder of the wearer W is larger. The shoulder-suspended member 118 is prevented from deteriorating comfort of the air-conditioning garment 100.

The shoulder-suspended member 118 is connected to the garment cloth F of the garment body 110 at the first connection 118*a* and the second connection 118*b*. In view of strength of connection, sewing is preferable for connection at the connections. However, sewn portions can be seen from the outer side of the garment body. They could deteriorate appearance of the air-conditioning garment.

However, according to the air-conditioning garment 100 of the embodiment, the first connection 118*a* and/or the second connection 118*b* overlap sewing lines that is inevitably generated when the garment body 110 is formed. It reduces deterioration in appearance of the air-conditioning garment 100 caused by the shoulder-suspended member 118.

Even in the case where only the first connection 118*a* and the second connection 118*b* at both ends of the shoulder-suspended member 118 are held by the garment cloth F of the garment body 110 while other portions of the shoulder-suspended member 118 are not fixed, the shoulder-suspended member 118 achieves the advantageous effect as long as the air-conditioning garment 100 is worn properly. However, every time the air-conditioning garment is put on, the wearer W must turn the shoulder-suspended member 118 to above the shoulder. Putting on the air-conditioning garment is troublesome.

Further, in that case, the shoulder-suspended member 118 may be displaced from a predetermined position on the shoulder while the air-conditioning garment is worn. As described above, even if a position of the shoulder-suspended member 118 is displaced, function of the shoulder-suspended member 118 is less likely to be lost as compared with common spacers. However, if the shoulder-suspended member 118 is significantly displaced to, for example, falls off the shoulder, its function is lost.

Contrary to this, according to the air-conditioning garment 100 of the embodiment, even in areas other than around the first connection 118*a* and the second connection 118*b*, the shoulder-suspended member holder 119 somewhat fixes a position of the shoulder-suspended member 118 in relation to the garment cloth F of the garment body 110. Therefore, the shoulder-suspended member 118 does not move significantly from the predetermined position. This eliminates the need for adjusting position every time the air-conditioning garment 100 is put on. The air-conditioning garment 100 is easily put on. The shoulder-suspended member 118 is prevented from significantly moving from the predetermined position while being worn.

Second Embodiment

A second embodiment of the present invention will be described with reference to FIG. 5. The same reference numerals are given to the portions same as those in the first embodiment, and explanation thereof are omitted.

Configuration of Embodiment

Figure 5:
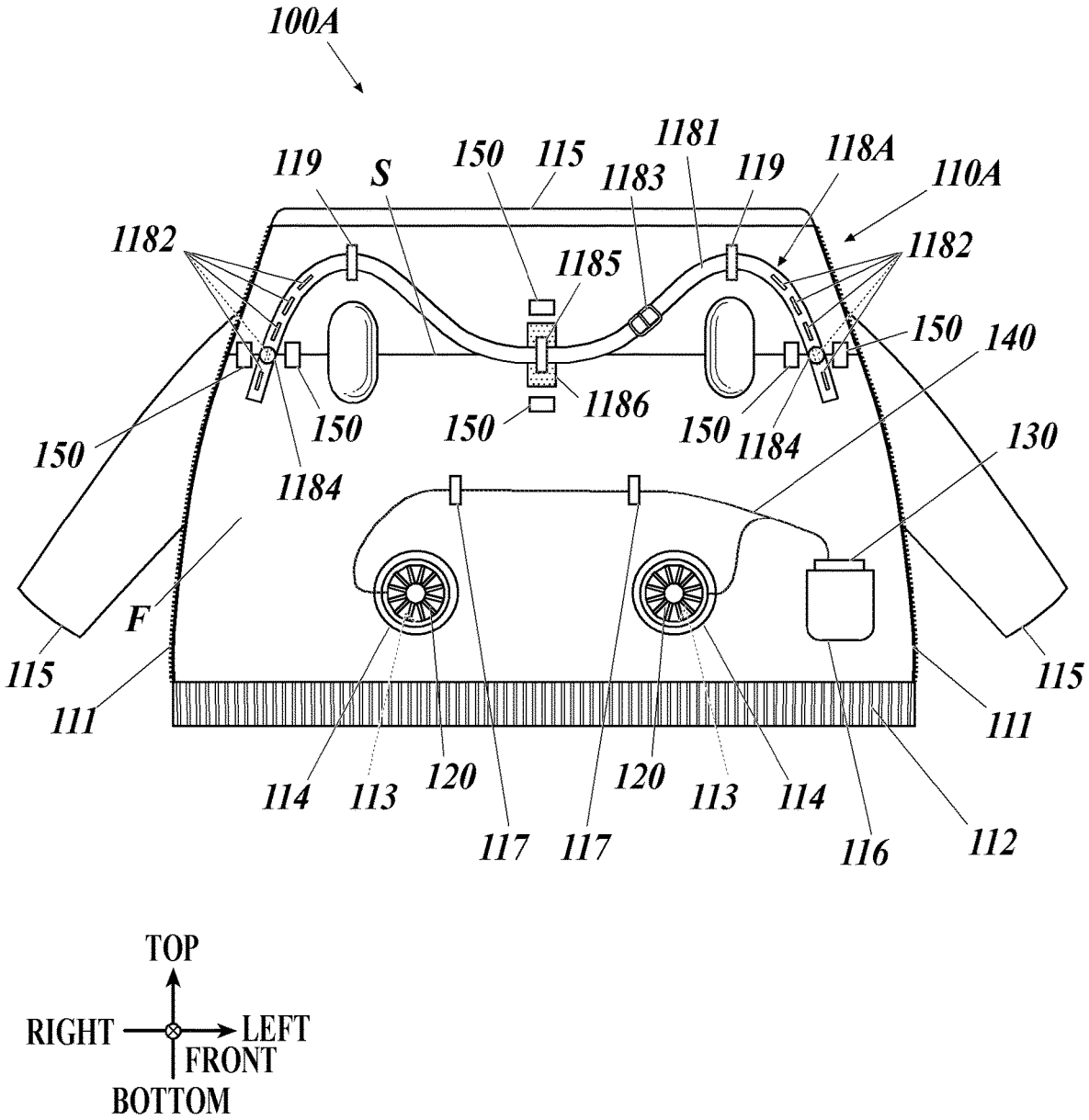
FIG. 5 is a front view of the air-conditioning garment according to the second embodiment in a state where a fastener of a front part is opened.

As shown in FIG. 5, the shoulder-suspended member of the air-conditioning garment 100A according to the second embodiment is a shoulder-suspended member 118A constituted by right and left shoulder-suspended members Mined together.

Shoulder-Suspended Member

As shown in FIG. 5, the shoulder-suspended member 118A includes a shoulder strap 1181, button holes 1182 around both ends of the shoulder strap 1181, a length adjuster 1183 provided to the shoulder strap 1181, a button 1184 provided to the front part of the garment body 110A, and a ring member 1185 provided to the back part of the garment body 110A.

As shown in FIG. 5, the shoulder strap 1181 is formed in a shape of a single band. The button holes 1182 are arranged along a longitudinal direction of the shoulder strap 1181 around each of both ends of the shoulder strap 1181.

The length adjuster 1183 that adjusts a length of the shoulder strap 1181 can be provided at any position other than around both ends of the shoulder strap 1181. The length adjuster 1183 can have any configuration as long as it can adjust the length of the shoulder strap 1181. For example, the length adjuster 1183 is a common strap adjuster. The length of the entire shoulder strap 1181 is adjusted by adjusting a length of a doubly overlapped portion of the shoulder strap 1181.

The button 1184 can be connected to the button hole 1182 provided in the shoulder strap 1181. The buttons 1184 are provided at two positions on the right and left on the inner surface of the front part of the garment cloth F of the garment body 110A. The shoulder strap 1181 is connected to the front part of the garment cloth F of the garment body 110A by connecting the button 1184 with the button hole 1182.

Thus, in the embodiment, the portion of the front part of the garment body 110A which is provided with the button 1184 is the first connection in the front part of the garment body 110A.

In this case, the button holes 1182 are the first connector while the button 1184 is the second connector.

As shown in FIG. 5, the ring member 1185 is a ring-shaped member around the center in a lateral direction of an upper portion of the back part of the garment body 110A. For example, a ring is formed by connecting both ends of an elongated cloth. The ring is attached to the garment cloth F of the garment body 110A such that an opening faces right and left. Thus, the ring member 1185 is formed.

The shoulder strap 1181 passes through the ring member 1185 around the center in the lateral direction of the upper portion of the back part of the garment body 110A. Thus, the shoulder strap 1181 is connected to the back part of the garment body 110A via the ring member 1185. Therefore, in the embodiment, the portion of the back part of the garment body 110A which is provided with the ring member 1185 is the second connection in the back part of the garment body 110A.

The ring member 1185 is not sewn on the garment cloth F. A part of an outer surface of the ring member 1185 is provided with one piece of a hook-and-loop fastener so as to be attachable and detachable to/from a ring connector 1186. The ring connector 1186 is constituted by the other piece of the hook-and-loop fastener provided in the garment cloth F of the garment body 110A on the inner side.

The ring connector 1186 is longer than the ring member 1185 in the vertical direction. The position where the ring member 1185 is attached to the ring connector 1186 can be adjusted in the vertical direction.

The shoulder-suspended member of the present invention is not limited to those always connect the first connection and the second connection. A member that can be attached and detached is also a shoulder-suspended member that connects the first connection and the second connection as long as it connects the first connection and the second connection.

Spacer

Spacers 150 keep a distance between the garment cloth F and the wearer W's body, and are provided in:

areas around positions where the buttons 1184 are provided (first connection) in the front part of the garment body 110A; and an area around a position where the ring member 1185 is attached (second connection) in the back part of the garment body 110A.

The spacer 150 can be any as long as it can keep the distance between the garment cloth F and the wearer W's body. For example, the spacer 150 is formed by attaching a sponge having a predetermined thickness to the garment cloth F.

Positions and the number of the spacers 150 are not limited to those shown in FIG. 5 as long as the spacers 150 are provided in:

areas around positions where the buttons 1184 are provided (first connection) in the front part of the garment body 110A; and an area around a position where the ring member 1185 is attached (second connection) in the back part of the garment body 110A.

The spacers 150 may be provided only in one of:

areas around positions where the buttons 1184 are provided (first connection) in the front part of the garment body 110A; and an area around a position where the ring member 1185 is attached (second connection) in the back part of the garment body 110A.

Not only in the embodiment but also in other embodiments, the spacers 150 may be provided around the first connection of the front part and/or around the second connection of the back part.

Advantageous Effect of Embodiment

According to the embodiment, a plurality of means adjust relation between:

the length of the portion of the shoulder-suspended member 118A between the first connection and the second connection.

the length of the portion of the garment cloth F facing the portion of the shoulder-suspended member 118A while the wearer N wears the air-conditioning garment 100A.

Button holes 1182 are provided at each of both ends of the shoulder strap 1181. A length of a portion of the shoulder strap 1181 between the buttons 1184 can be changed by changing the button hole 1182 to be connected with the button 1184.

The length of the portion of the shoulder strap 1181 between the buttons 1184 can be changed also by changing the length of the shoulder strap 1181 itself with the length adjuster 1183.

Since the ring connector 1186 is long in the vertical direction, a length of a portion of the garment cloth F facing the portion of the shoulder-suspended member 118A between the first connection and the second connection can be changed by vertically adjusting a position where the ring member 1185 is attached to the garment cloth F. The above portion of the garment cloth F is shortened by attaching the ring member 1185 to an upper portion of the garment cloth F. On the contrary, the above portion of the garment cloth F is lengthened by attaching the ring member 1185 to a lower portion of the garment cloth F.

The wearer W uses one or more of the above three means to make the length of the portion of the shoulder-suspended member 118 between the first connection and the second connection shorter than the length of the portion of the garment cloth facing the portion of the shoulder-suspended member 118 while the wearer W wears the air-conditioning garment 100A. It brings the same effect as the first embodiment.

The air-conditioning garment 100A is worn so that the shoulder straps 1181 of the shoulder-suspended members 118A are suspended from the shoulders of the wearer W. Thereby, an air flow passage is formed between the shoulder strap 1181 of the shoulder-suspended member 118A and the garment cloth F around the shoulder strap 1181, especially above the shoulder strap 1181. Thus, the shoulder-suspended member 118A does not block space around the shoulder. The air flow passage around the shoulder is efficiently formed.

The shoulder-suspended member 118A connects the front part and the back part of the garment body. Since the shoulder-suspended member 118A extends from the front side to the rear side over the shoulder of the wearer W, the weight of the air-conditioning garment is not concentrated on one point on the shoulder of the wearer W. The shoulder-suspended member 118A hardly deteriorate the comfort.

According to the embodiment, as described above, a plurality of means adjust relation between:

the length of the portion of the shoulder-suspended member 118A between the first connection and the second connection; and the length of the portion of the garment cloth F facing the portion of the shoulder-suspended member 118A while the wearer W wears the air-conditioning garment 100A.

Therefore, for example, in cases where cooling function is to be improved, such as a case where ambient temperature is high, difference in length between two portions is increased, the two portions being:

the portion of the shoulder-suspended member 118A between the first connection and the second connection; and the portion of the garment cloth F facing the portion of the shoulder-suspended member 118A while the wearer W wears the air-conditioning garment 100A.

It widens the air flow passages formed around the shoulders to enhance the cooling function of the air-conditioning garment.

On the other hand, in cases where the cooling function is not required so much, such as a case where ambient temperature is low, the difference in length between two portions is reduced, the two portions being:

the portion of the shoulder-suspended member 118A between the first connection and the second connection; and the portion of the garment cloth F facing the portion of the shoulder-suspended member 118A while the wearer W wears the air-conditioning garment 100A.

It narrows the air flow passage formed around the shoulder. Although the cooling function of the air-conditioning garment declines, the shoulders do not rise so much, and appearance of the air-conditioning garment is less likely to deteriorate.

In a case where the fan 120 is stopped and the air conditioning garment 100A is used as normal clothes, the air flow passages around the shoulders are not necessary. Therefore, the length of the portion of the shoulder-suspended member 118A between the first connection and the second connection is adjusted to be substantially the same as the length of the portion of the garment cloth F facing the portion of the shoulder-suspended member 118A while the wearer W wears the air-conditioning garment 100A.

According to the embodiment, the spacers 150 are provided in:

areas around positions where the buttons 1184 are provided (first connection) in the front part of the garment body 110A; and an area around a position where the ring member 1185 is attached (second connection) in the back part of the garment body 110A.

In a case where the air-conditioning garment 100A is used with the shoulder straps 1181 of the shoulder-suspended members 118A being suspended from the shoulders of the wearer W, the garment cloth F is pulled toward the wearer W in:

positions where the buttons 1184 to which the shoulder-suspended member 118A is connected are provided; and the position where the ring member 1185 is attached.

The garment cloth F of the garment body 110A tends to be dented inward around the above two positions. Such a dent obstructs flow of air in the portions. It may interfere with the cooling function of the air-conditioning garment, and may spoil appearance of the air-conditioning garment.

In this regard, according to the embodiment, the spacer 150 prevents the garment cloth F of the garment body 110A from being dented around:

positions where the buttons 1184 for connecting the shoulder-suspended member 118A to the garment cloth F are provided; and the position where the ring member 1185 is attached.

Therefore, the above-mentioned negative effect does not occur.

Modification

In the above description, three means are employed to adjust relation between:

the length of the portion of the shoulder-suspended member 118A between the first connection and the second connection; and the length of the portion of the garment cloth F facing the portion of the shoulder-suspended member 118A while the wearer W wears the air-condoning garment 100A.

The three means are:

a plurality of button holes 1182 provided at each of both ends of the shoulder strap 1181;

the length adjuster 1183 provided in the shoulder strap 1181; and the vertical adjustment of the position where the ring member 1185 is attached.

Not all of those three means need to be provided. One or two of them may be selectively adopted.

Means for attaching and separating the shoulder strap 1181 to/from the garment cloth F may not be the button holes 1182 at both ends and the buttons 1184. It is also possible that only one end is attached and separated to/from the garment cloth F with the button holes 1182 and the button 1184 while the other end of the shoulder-suspended member 1181 is fixed to the garment cloth F by sewing or the like.

The ring member 1185 may not be used also in the second connection in the back part of the garment body 110A.

In that case, the shoulder strap 1181 is connected to the garment cloth F using:

a button hole 1182 provided in the center of the shoulder strap 1181; and a button 1184 provided in the back part of the garment cloth F of the garment body 110A.

The button 1184 may be provided at several positions. In that case, a position of the second connection where the shoulder-suspended member 118A is connected to the back part can be changed by changing the button 1184 to be used.

It is possible to adjust relation between:

the length of the portion of the shoulder-suspended member 118A between the first connection and the second connection; and the length of the portion of the garment cloth F facing the portion of the shoulder-suspended member 118A while the wearer W wears the air-conditioning garment 100A.

The button 1184 may be provided at several positions also in the front part of the garment body 110A. A position of the first connection where the shoulder-suspended member 118A is connected to the back part can be changed by changing the button 1184 to be used.

It is possible to adjust relation between:

the length of the portion of the shoulder-suspended member 118A between the first connection and the second connection; and the length of the portion of the garment cloth F facing the portion of the shoulder-suspended member 118A while the wearer W wears the air-conditioning garment 100A.

A plurality of button holes 1182 and a plurality of buttons 1184 may be provided in the shoulder strap 1181 and the garment cloth F respectively.

It is also possible that the buttons 1184 are provided in the shoulder strap 1181 while the button holes 1182 are provided in the garment cloth F, although it is not preferable because it increases slits in the garment cloth F. In that case, the buttons 1184 are the first connector while the button holes 1182 are the second connector.

Third Embodiment

A third embodiment of the present invention will be described with reference to FIGS. 6 to 7. The same reference numerals are given to the portions same as those in the first embodiment, and explanation thereof are omitted.

Configuration of Embodiment

Figure 6:
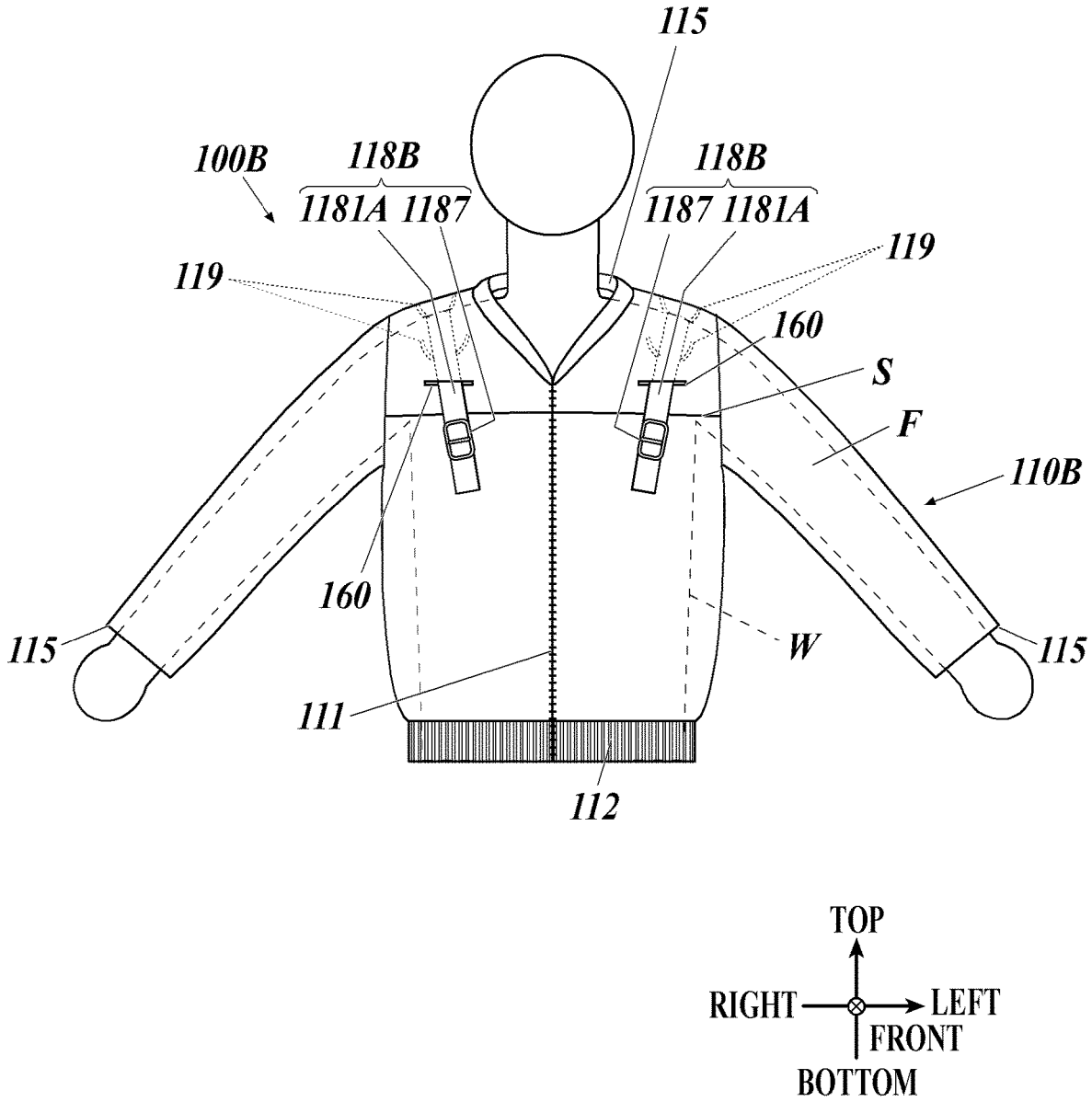
FIG. 6 is a front view of an upper body of a wearer wearing an air-conditioning garment according to a third embodiment. A garment cloth of a garment body is inflated by operating a fan. A power source, connection cable, etc. are omitted.
Figure 7:
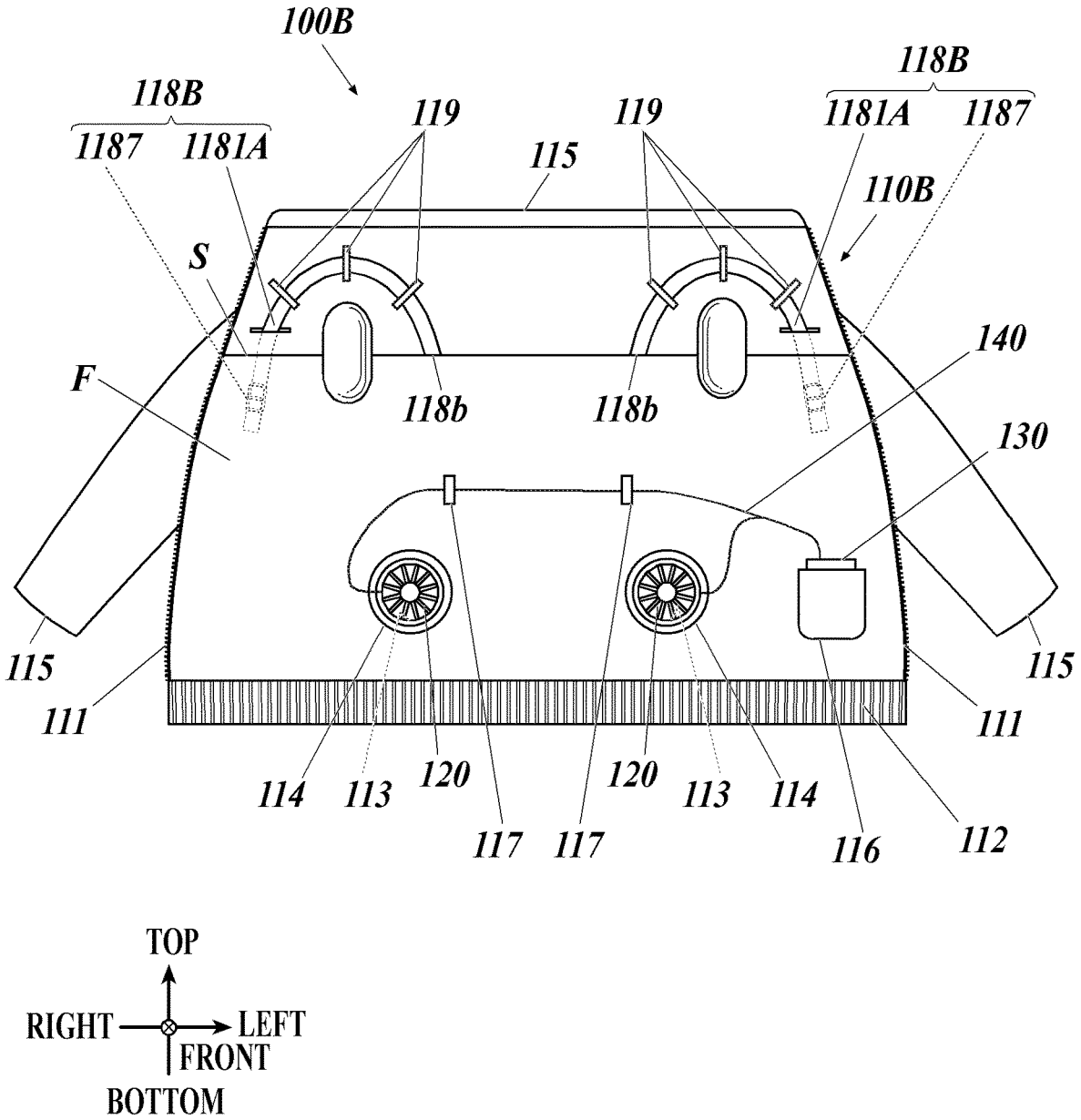
FIG. 7 is a front view of the air-conditioning garment according to the third embodiment in a state where a fastener of a front part is opened.

As shown in FIGS. 6 to 7, the shoulder-suspended member in the air-conditioning garment 100B according to the third embodiment is a shoulder-suspended member 118B that includes:

a shoulder strap 1181A including one end connected to the inner surface of the back part of the garment body 110B and the other end drawn out to the outer side of the garment cloth F through an opening 160 formed in the front part of the garment cloth F; and a strap adjuster 1187 which fixes the shoulder strap 1181A and which is attached to the outer surface of the front part of the garment cloth F of the garment body 110B.

Opening

As shown in FIGS. 6 to 7, the openings 160 are provided to an upper portion of the front part of the garment body 110B at positions on the right and left sides of the fastener 111. The opening 160 is a slit extending in the lateral direction, and penetrates the garment cloth F to connect the inner side and the outer side of the garment cloth. F.

To prevent air from leaking from the space between the garment body 110 and the wearer W's body, it is desirable that the opening 160 has a minimum size that allows the shoulder strap 1181A to be inserted. It is more desirable to include a cover although it is not shown in FIG. 6. The cover covers the opening 160 from above, and only a lower part opens.

Shoulder-Suspended Member

As described above, the shoulder-suspended member 118B includes:

the shoulder strap 1181A including one end connected to the inner surface of the back part of the garment body 110B and the other end drawn out to the outer side of the garment cloth F through the opening 160; and the strap adjuster 1187 attached to the garment cloth F on the outer side of the front part.

As shown in FIG. 7, the shoulder strap 1181A is a band connected to the garment cloth F at the second connection 118*b* in the upper portion of the back part of the garment body 110C, as in the first embodiment. Two shoulder straps 1181A on the right and left are provided.

The shoulder strap 1181A has a width that allows the shoulder strap 1181A to pass through the opening 160. The shoulder strap 1181A needs to be long enough to be pulled out to the outer side of the garment cloth F through the opening 160 and connected to the strap adjuster 1187 while the shoulder strap 1181A is suspended from the shoulder of the wearer W as described later.

The shoulder strap 1181A is sewn on the sewing line S at the time when the garment cloth F is sewn. The sewing line S is a line on which the garment cloth F is sewn to form the garment body 1105. Thus, the shoulder straps 1181A are fixed to the back part of the garment cloth F of the garment body 110B at two positions on the right and left.

The strap adjuster 1187 connects the shoulder strap 1181A to the outer surface of the front part of the garment cloth F of the garment body 110B. The strap adjuster 1187 is provided on the outer surface of the front part of the garment cloth F, below the opening 160.

Thus, in the embodiment, a portion of the outer surface of the front part of the garment body 1108 which is provided with the strap adjuster 1187 is the first connection in the front part of the garment body 110B.

The strap adjuster 1187 may be a common strap adjuster as long as:

any part of the shoulder strap 1181A can be fixed to the strap adjuster 1187 by passing the shoulder strap 1181A through the strap adjuster 1187; and the fixed part can be changed.

Advantageous Effect of Embodiment

According to the embodiment, any part of the shoulder strap 1181A can be fixed to the strap adjuster 1187 by passing the shoulder strap 1181A through the strap adjuster 1187. The length of the portion of the shoulder-suspended member 118B between the first connection and the second connection in a state where the shoulder strap 1181A is fixed to the strap adjuster 1187 can be changed by changing the part to be fixed.

The portion of the shoulder-suspended member 118B between the first connection and the second connection is made shorter than the portion of the garment cloth F facing the portion of the shoulder-suspended member 118B while the wearer W wears the air-conditioning garment 100B. It brings the same effect as the first embodiment.

According to the embodiment, any part of the shoulder strap 1181A can be fixed to the strap adjuster 1187. The length of the portion of the shoulder-suspended member 118B between the first connection and the second connection in the state where the shoulder strap 1181A is fixed to the strap adjuster 1187 can be adjusted by changing the part to be fixed.

Like the second embodiment, the air flow passage formed around the shoulder can be widened by increasing the difference in length between:

the portion of the shoulder-suspended member 118B between the first connection and the second connection; and the portion of the garment cloth F facing the portion of the shoulder-suspended member 118B while the wearer W wears the air-conditioning garment 100B.

It enhances cooling function of the air-conditioning garment.

In contrast, the air flow passage formed around the shoulder can be narrowed by reducing the difference in length between:

the portion of the shoulder-suspended member 118B between the first connection and the second connection; and the portion of the garment cloth F facing the portion of the shoulder-suspended member 118B while the wearer W wears the air-conditioning garment 100B.

Although it reduces cooling function of the air-conditioning garment, the shoulders do not rise so much, and appearance of the air-conditioning garment is less likely to deteriorate.

In the case where the fan 120 is stopped and the air conditioning garment 100B is used as normal clothes, the air flow passages around the shoulders are not necessary. Therefore, the length of the portion of the shoulder-suspended member 118B between the first connection and the second connection is adjusted to be substantially the same as the length of the portion of the garment cloth. F facing the portion of the shoulder-suspended member 118B while the wearer W wears the air-conditioning garment 100B.

According to the embodiment, one end of the shoulder strap 1181A is exposed from the opening 160 in the front part to the outer side of the garment body 110B, and is fixed to the strap adjuster 1187 on the outer side of the garment body 1108. A position where the shoulder strap 1181A is connected to the strap adjuster 1187 on the outer side of the garment body 110B can be changed. Therefore, the length of the portion of the shoulder-suspended member 118B between the first connection and the second connection is easily adjusted.

Fourth Embodiment

A fourth embodiment of the present invention will be described with reference to FIGS. 8 to 9. The same reference numerals are given to the portions same as those in the first embodiment, and explanation thereof are omitted.

Configuration of Embodiment

Figure 8:
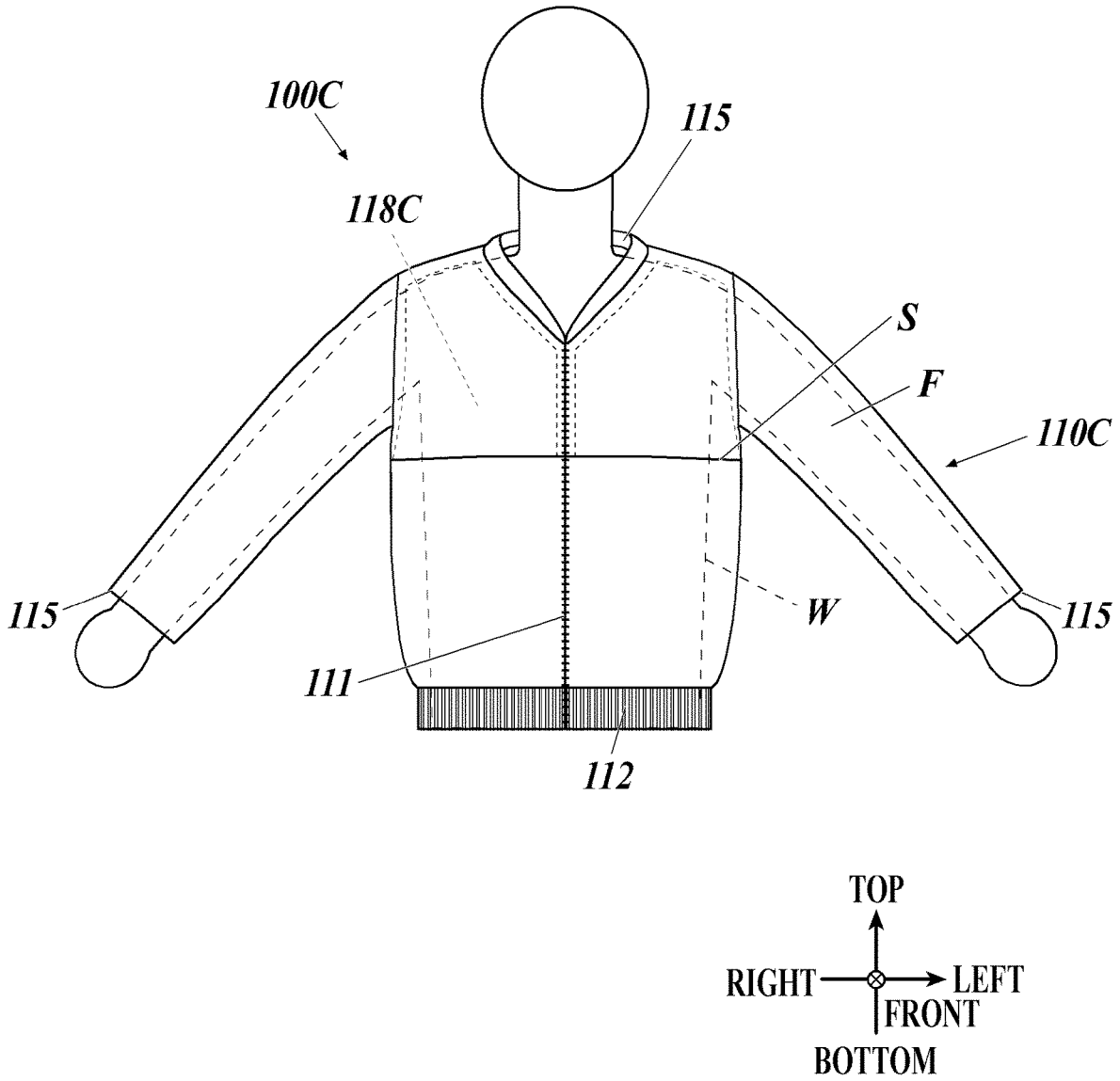
FIG. 8 is a front view of an upper body of a wearer wearing an air-conditioning garment according to a fourth embodiment. A garment cloth of a garment body is inflated by operating a fan. A power source, a connection cable, etc. are omitted.
Figure 9:
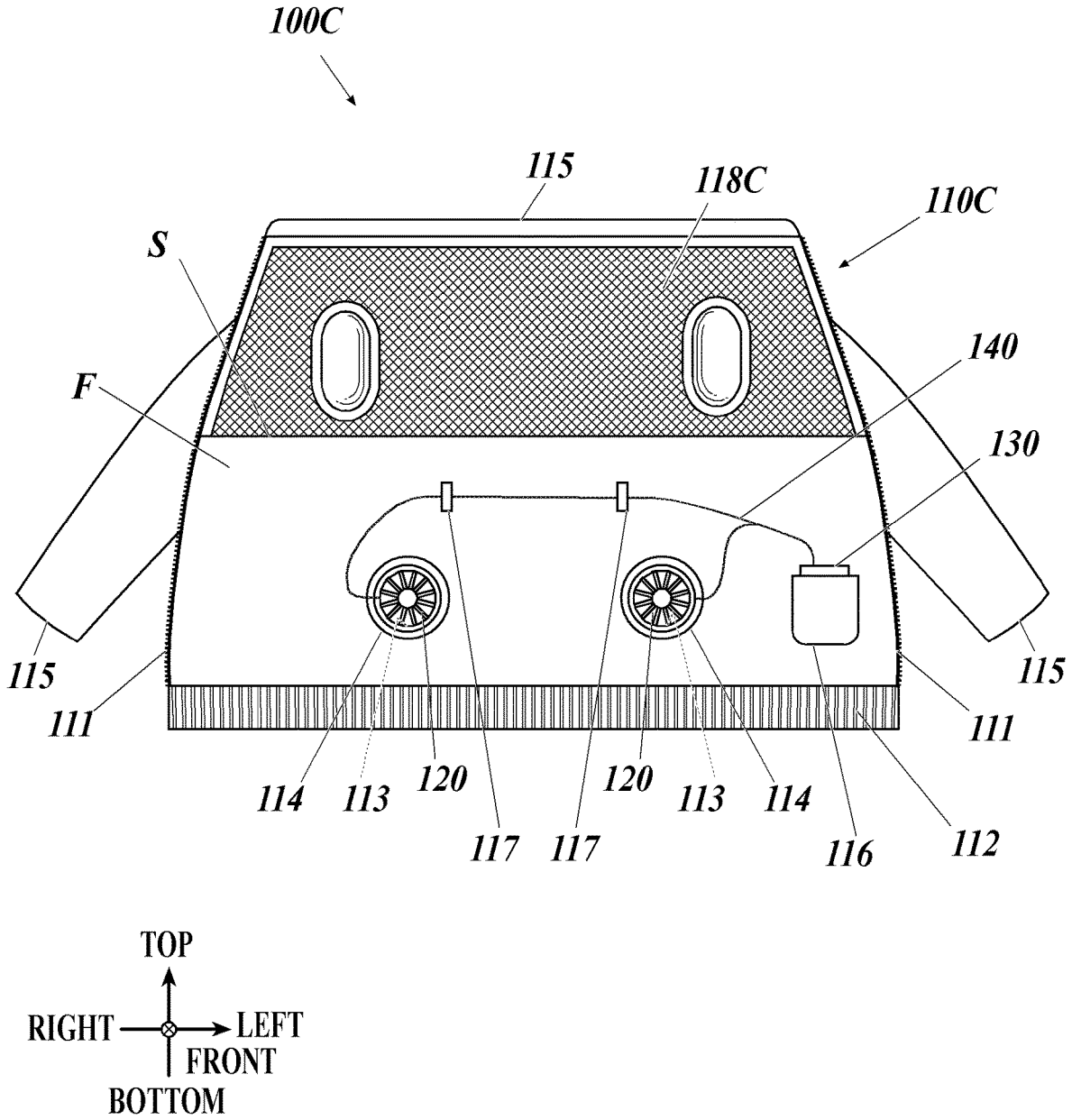
FIG. 9 is a front view of the air-conditioning garment according to the fourth embodiment in a state where a fastener of a front part is opened.

As shown in FIGS. 8 to 9, the shoulder-suspended member in the air-conditioning garment 1000 according to the fourth embodiment is a shoulder-suspended member 118C constituted by a mesh member that covers an upper portion of the trunk of the wearer.

Shoulder-Suspended Member

As shown in FIGS. 8 to 9, the shoulder-suspended member 1180 is constituted by the mesh member provided in an upper portion of the inner surface of the garment cloth F of the garment body 110C. The mesh member is a sheet member in which a large number of openings are formed over substantially the entire surface.

As shown in FIGS. 8 to 9, the shoulder-suspended member 118C is connected to the garment cloth F inside a portion of the garment body 1100 where the trunk is connected with the sleeves. The shoulder-suspended member 1180 is wound around the garment body 1100 except for the vicinity of the fastener 111 in the front part. The shoulder-suspended member 118C is connected to the garment cloth F by sewing the shoulder-suspended member 1180 on the sewing line S at the time when the garment cloth F is sewn.

Thus, in the embodiment, of connected portions between the garment cloth F and the shoulder-suspended member 118C wound around the garment body 1100 except for the vicinity of the fastener 111 in the front part, a portion connected with a portion of the front part on both sides of the fastener 111 is the first connection in the front part of the garment body 110C. A portion connected to the back part is the second connection in the back part of the garment body 110C.

Connected portions between the shoulder-suspended member 118C and the garment cloth F are not limited to the above portions. For example, the shoulder-suspended member 118C may be connected to the garment cloth F along the fastener 111 on the right and left sides of the fastener 111.

Thus, as shown in FIG. 8, the shoulder-suspended member 118C has a shape as if only an upper portion of a sleeveless shirt is attached to the inner surface of the garment cloth F. This can be suspended from both shoulders of the wearer when the air-conditioning garment 1000 is worn.

As shown in FIG. 8, the shoulder-suspended member 118C is one size smaller than the upper portion of the garment cloth F facing the shoulder-suspended member 118C while the wearer W wears the air-conditioning garment 100C. Therefore, space is created between the shoulder-suspended member 118C and the garment cloth F.

Advantageous Effect of Embodiment

The air-conditioning garment 100C is worn so that the shoulder-suspended member 118C is suspended from the shoulders of the wearer W. Around the shoulder of the wearer W, especially above the shoulder, an air flow passage is formed between the shoulder-suspended member 118C and a portion of the garment cloth F around the shoulder-suspended member 118C. The embodiment achieves the same effect as the first embodiment. According to the embodiment, the shoulder-suspended member 118C has a larger area than that of the first embodiment. However, since the entire shoulder-suspended member 118C is constituted by the mesh member, the shoulder-suspended member 118C does not obstruct air flow inside the garment body 110C.

According to the embodiment, weight of the air-conditioning garment 100C is spread over a wide area on the shoulders of the wearer by the shoulder-suspended member 118C having a large area. The embodiment is less likely to deteriorate comfort of the air-conditioning garment 100 than the first embodiment.

Fifth Embodiment

A fifth embodiment of the present invention will be described with reference to FIG. 10. The same reference numerals are given to the portions same as those in the first embodiment, and explanation thereof are omitted.

Configuration of Embodiment

Figure 10:
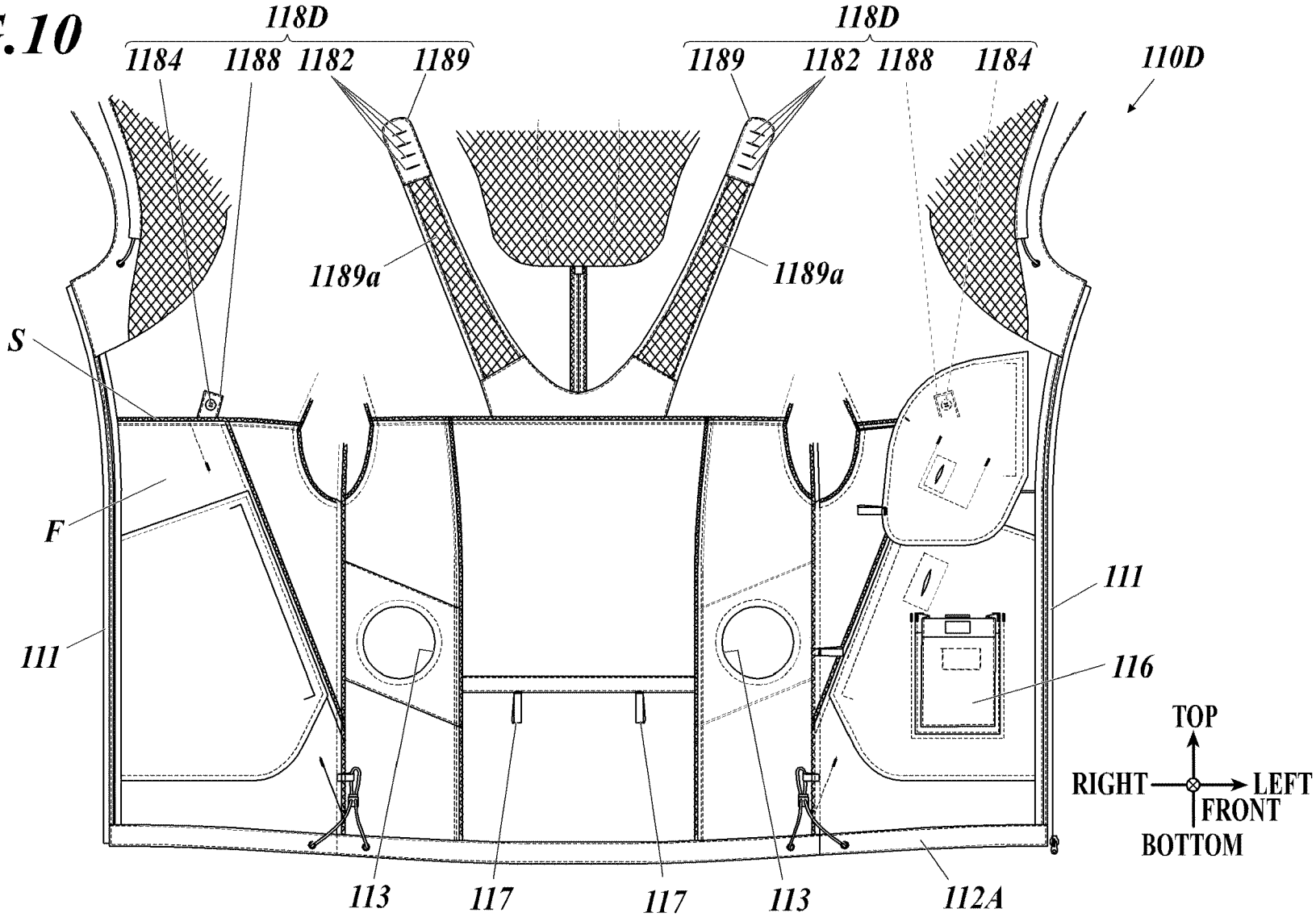
FIG. 10 a front view of the garment body of an air-conditioning garment according to a fifth embodiment in a state where a fastener of a front part is opened.

As shown in FIG. 10, the shoulder-suspended member in the air-conditioning garment according to the fifth embodiment is a shoulder-suspended member 118D that includes:

a first shoulder strap 1188 connected to the front part of the garment body 110D; and a second shoulder strap 1189 connected to the back part of the garment body 110D.

Shoulder-Suspended Member

As described above, the shoulder-suspended member 118D includes the first shoulder strap 1188 connected to the front part of the garment body 110D and the second shoulder strap 1189 connected to the back part of the garment body 110D. A button 1184 provided in the first shoulder strap 1188 and button holes 1182 provided in the second shoulder strap 1189 can be connected.

As shown in FIG. 10, around the center of the back part of the garment body 110D in the lateral direction, the right and left second shoulder straps 1189 are joined together and fixed to the inner surface of the garment cloth F. The second shoulder strap 1189 is fixed to the garment cloth F by sewing the second shoulder strap 1189 on the sewing line S at the time when the garment cloth F is sewn. The sewing line S is the line on which the garment cloth F is sewn to form the garment body 110D.

In the embodiment, the connection between the second shoulder strap 1189 and the back part of the garment body 110D is the second connection in the back part of the garment body 110D.

As shown in FIG. 10, the second shoulder strap 1189 includes the button holes 1182 around the end opposite to the end connected to the back part of the garment cloth F. The button holes 1182 are arranged along a longitudinal direction of the second shoulder strap 1189.

The second shoulder strap 1189 includes a mesh member 1189*a* on the side facing the wearer W to prevent getting sweaty.

As shown in FIG. 10, the first shoulder strap 1188 is smaller than the second shoulder strap 1189. The first shoulder strap 1188 slightly protrudes from the inner side of the garment cloth F of the garment body 110D, and is fixed to the front part of the garment body 110D at two positions on the right and left. Like the second shoulder strap 1189, the first shoulder strap 1188 is also fixed to the garment cloth F by sewing the first shoulder strap 1188 on the sewing line S at the time when the garment cloth F is sewn. The sewing line S is the line on which the garment cloth F is sewn to form the garment body 110D.

In the embodiment, the connection between the first shoulder strap 1188 and the front part of the garment body 110D is the first connection in the front part of the garment body 110D.

As shown in FIG. 10, the first shoulder strap 1188 includes the button 1184 that can be connected to the button holes 1182 of the second shoulder strap 1189.

Thus, the button 1184 is the first connector while the button holes 1182 are the second connector.

Configuration of the shoulder-suspended member 118D is determined based on:

a first length from the portion of the first shoulder strap 1188 which is connected to the garment cloth F (first connection) to the center of the button 1184;

a second length from the portion of the second shoulder strap 1189 which is connected to the garment cloth F (second connection) to the button hole 1182; and a third length of the portion of the garment cloth F facing the portion of the shoulder-suspended member 118D between the first connection and the second connection while the wearer S wears the air-conditioning garment.

In a case where the button hole 1182 farthest from a portion of the second shoulder strap 1189 which is connected to the garment cloth F is used, the sum of the first length and the second length is substantially the same as the third length. In a case where other button holes 1182 are used, the sum of the first length and the second length is shorter than the third length.

Other Configuration

As shown in FIG. 10, the garment body 110D of the embodiment has a shape of a jacket with a hood.

In the hem of the garment body 110D, the air seal 112A includes:

a cord loop wound around the body of the wearer except for the vicinity of the fastener 111;

a cord member passing through the cord loop; and a cord stopper provided in a portion of the cord member which comes out of the cord loop.

By fixing the cord stopper after pulling the portion of the cord member which comes out of the cord loop, the hem of the garment body 110D is brought into close contact with the body of the wearer.

Although FIG. 10 shows a lot of parts, such as seams of the garment cloth F for forming the garment body 110D, they do not affect the advantageous effect of the present invention.

Although FIG. 10 does not show configuration other than the garment body 110D, the fan 120, the power source 130, and the connection cable 140 are the same as those in the first embodiment.

The first shoulder strap 1188 on the left is provided inside an inner pocket and can be connected to the second shoulder strap 1189 through an opening at the top of the inner pocket.

Advantageous Effect of Embodiment

According to the embodiment, a plurality of button holes 1182 are provided in the second shoulder strap 1189. Therefore, when the first shoulder strap 1188 and the second shoulder strap 1189 are connected using the button holes 1182 and the button 1184, the length of the portion of the shoulder-suspended member 118D between the first connection and the second connection can be changed by changing the button hole 1182 connected to the button 1184 of the first shoulder strap 1188.

In a case where the button hole 1182 other than the button hole 1182 farthest from the connection between the second shoulder strap 1189 and the garment cloth F is used, the length of the portion of the shoulder-suspended member 118D between the first connection and the second connection is shorter than the length of the portion of the garment cloth F facing the portion of the shoulder-suspended member 118D while the wearer W wears the air-conditioning garment. It brings the same effect as the first embodiment.

According to the embodiment, the button hole 1182 used for connection is changed to adjust relation between:

the length of the portion of the shoulder-suspended member 118D between the first connection and the second connection; and the length of the portion of the garment cloth F facing the portion of the shoulder-suspended member 118D while the wearer W wears the air-conditioning garment.

Like the second embodiment and the third embodiment, the air flow passage formed around the shoulder can be widened by increasing the difference in length between:

the portion of the shoulder-suspended member 118D between the first connection and the second connection; and the portion of the garment cloth F facing the portion of the shoulder-suspended member 118D while the wearer W wears the air-conditioning garment.

It enhances cooling function of the air-conditioning garment.

On the other hand, the air flow passage formed around the shoulder is narrowed by reducing the difference in length between:

the portion of the shoulder-suspended member 118D between the first connection and the second connection; and the portion of the garment cloth F facing the portion of the shoulder-suspended member 118D while the wearer W wears the air-conditioning garment.

Although it reduces cooling function of the air-conditioning garment, the shoulders do not rise so much, and appearance of the air-conditioning garment is less likely to deteriorate.

In the case where the fan 120 is stopped and the air-conditioning garment is used as normal clothes without using function as an air-conditioning garment, the air flow passage around the shoulder is not necessary. Therefore, the button hole farthest from the connection between the second shoulder strap 1189 and the garment cloth F is used. As a result, the length of the portion of the shoulder-suspended member 118D between the first connection and the second connection is substantially the same as the length of the portion of the garment cloth F facing the portion of the shoulder-suspended member 118D while the wearer W wears the air-conditioning garment.

Modification

The case where the second shoulder strap 1189 includes the plurality of button holes 1182 is described above. On the contrary, it is possible to increase the size of the first shoulder strap 1188 and to provide the first shoulder strap 1188 with a plurality of buttons 1184. It makes it possible to change the length of the portion of the shoulder-suspended member 118D between the first connection and the second connection while the button hole 1182 and the button 1184 are connected. A plurality of button holes 1182 and a plurality of buttons 1184 may be provided in the second shoulder strap 1189 and the first shoulder strap 1188 respectively.

It is also possible that the first shoulder strap 1188 is provided with the button holes 1182 while the second shoulder strap 1189 is provided with the button 1184. In that case, the button holes 1182 are the first connector, and the button 1184 is the second connector.

INDUSTRIAL APPLICABILITY

The present, invention is suitably used in the field of manufacturing air-conditioning garments and bodies of air-conditioning garments.

REFERENCE SIGNS LIST

100, 100A, 100B, 1000 air-conditioning garment
110, 110A, 110B, 110C, 110D garment body
118, 118A, 118B, 118C, 118D shoulder-suspended member
1181, 1181A shoulder strap
1182 button holes (first connector, second connector)
1183 length adjuster
1184 button (second connector, first connector)
1185 ring member
1188 first shoulder strap
1189 second shoulder strap
118*a* first connection
118*b* second connection
119 shoulder-suspended member holder
120 fan (ventilator)
130 power source
140 connection cable (power source)
150 spacer
160 opening
F garment cloth
S sewing line
W wearer

The invention claimed is:

1. A body of an air-conditioning garment, comprising:

a garment cloth which is not breathable or has sufficient breathability to be inflated by introduction of air by a ventilator and which forms the body in a shape that is configured to cover at least a trunk of a wearer;

an air seal that is formed at a hem of the body;

an air outlet;

a shoulder-suspended member that connects a first connection in a front part of the body with a second connection in a back part of the body; and a shoulder-suspended member holder that holds the shoulder-suspended member in a predetermined position, wherein in a state in which the wearer wears the body of the air-conditioning garment;

the shoulder-suspended member is suspended from shoulders of the wearer;

the first connection of the shoulder-suspended member is located in front of a shoulder area of the wearer, and the second connection of the shoulder-suspended member is located behind the shoulder area of the wearer;

the shoulder-suspended member holder is positioned at an inner side of the body, at a position different from the first connection and the second connection;

at least part of the shoulder-suspended member is positioned between the wearer and the body of the air-conditioning garment;

the shoulder-suspended member is shorter than a portion of the garment cloth facing the shoulder-suspended member, the portion of the garment cloth being a portion between the first connection and the second connection in a direction passing over the shoulders of the wearer;

the first connection of the shoulder-suspended member includes a left first connection in front of a left shoulder area of the wearer, and a right first connection in front of a right shoulder area of the wearer;

the shoulder-suspended member includes a left shoulder part which passes over a left shoulder of the wearer and is connected to the left first connection part, and a right shoulder part which passes over a right shoulder of the wearer and is connected to the right front connection part;

the left shoulder part and the right shoulder part of the shoulder-suspended member do not cross each other in front of the wearer;

the air seal comes into contact with the wearer at the hem of the body;

the air outlet is positioned in an area around a neck of the wearer; and when the ventilator introduces air in a state in which the wearer wears the body of the air-conditioning garment and the shoulder-suspended member is suspended on the shoulders of the wearer, a flow passage is formed through which the air introduced by the ventilator flows between the shoulder-suspended member and the portion of the garment cloth facing the shoulder-suspended member and is then discharged through the air outlet;

wherein each left and right shoulder parts comprise a first shoulder strap connected to the first connection, and a second shoulder strap connected to the second connection, and wherein the first shoulder strap and the second shoulder strap are detachably connected; and wherein in each of the left and right shoulder parts:

the first shoulder strap comprises one or more first connectors, the second shoulder strap comprises one or more second connectors which can be attached to and detached from the first connectors, and a number of the first connectors is plural, and/or a number of the second connectors is plural.

2. The body of the air-conditioning garment according to claim 1, further comprising:

a spacer which keeps a distance between the trunk of the wearer and the garment cloth and which is around at least one of the first connection and the second connection.

3. The body of the air-conditioning garment according to claim 1, wherein:

at least one of the first connection and the second connection is on a sewing line of the garment cloth, and the shoulder-suspended member is sewn on the garment cloth at at least one of the first connection and the second connection.

4. An air-conditioning garment, comprising:

the body of the air-conditioning garment according to claim 1;

the ventilator that introduces air inside the body of the air-conditioning garment; and a power source that supplies power to the ventilator.

5. The body of the air-conditioning garment according to claim 1, wherein the second shoulder strap of the left shoulder part and the second shoulder strap of the right shoulder part are joined together and fixed to an inner surface of the garment cloth at the second connection around a center of the back part of the body.

6. The body of the air-conditioning garment according to claim 1, wherein each of the second shoulder strap of the left shoulder part and the second shoulder strap of the right shoulder part comprises a mesh member.

7. A body of an air-conditioning garment, comprising:

a garment cloth which is not breathable or has sufficient breathability to be inflated by introduction of air by a ventilator and which forms the body in a shape that is configured to cover at least a trunk of a wearer;

an air seal that is formed at a hem of the body;

an air outlet;

a shoulder-suspended member that connects a first connection in a front part of the body with a second connection in a back part of the body; and a shoulder-suspended member holder that holds the shoulder-suspended member in a predetermined position, wherein in a state in which the wearer wears the body of the air-conditioning garment:

the first connection of the shoulder-suspended member is located in front of a shoulder area of the wearer, and the second connection of the shoulder-suspended member is located behind the shoulder area of the wearer;

the shoulder-suspended member is positioned between the wearer and the body of the air-conditioning garment, passes over shoulders of the wearer, and is suspended from the shoulders of the wearer;

the shoulder-suspended member is shorter than a portion of the garment cloth facing the shoulder-suspended member, the portion of the garment cloth being a portion between the first connection and the second connection in a direction passing over the shoulders of the wearer;

the air seal comes into contact with the wearer at the hem of the body;

the air outlet is positioned in an area around a neck of the wearer;

the shoulder-suspended member forms a flow passage through which the air introduced by the ventilator flows between the shoulder-suspended member and the portion of the garment cloth facing the shoulder-suspended member and is then discharged through the air outlet;

the shoulder-suspended member comprises a shoulder strap which has a shape of a band or a cord;

the shoulder strap comprises:

a first shoulder strap connected to the first connection; and a second shoulder strap connected to the second connection;

the first shoulder strap and the second shoulder strap are detachably connected;

the first shoulder strap comprises one or more first connectors, the second shoulder strap comprises one or more second connectors which can be attached to and detached from the first connectors, and a number of the first connectors is plural, and/or a number of the second connectors is plural.

* * * * *